US005416264A

United States Patent [19]

Toda et al.

[11] Patent Number: 5,416,264

[45] Date of Patent: May 16, 1995

[54] WAVEFORM-FORMING DEVICE HAVING MEMORY STORING NON-COMPRESSED/COMPRESSED WAVEFORM SAMPLES

[75] Inventors: Hiroyuki Toda; Tetsuji Ichiki, both of Hamamatsu, Japan

[73] Assignee: Yamaha Corporation, Japan

[21] Appl. No.: 97,163

[22] Filed: Jul. 23, 1993

[30] Foreign Application Priority Data

Jul. 27, 1992 [JP] Japan ..... 4-219751
Dec. 26, 1992 [JP] Japan ..... 4-359637

[51] Int. Cl.[6] ..... G10H 1/057; G10H 7/04

[52] U.S. Cl. ..... 84/603; 84/605; 84/607

[58] Field of Search ..... 84/602–607, 84/622–627

[56] References Cited

U.S. PATENT DOCUMENTS 4,876,935 10/1989 Kitagawa ..... 84/627
4,916,996 4/1990 Suzuki et al. .
5,252,773 10/1993 Kozuki et al. ..... 84/607
5,290,965 3/1994 Yoshida et al. ..... 84/605
5,329,062 7/1994 Kaneko ..... 84/603
5,347,087 9/1994 Kozuki ..... 84/605

FOREIGN PATENT DOCUMENTS 0273447 12/1987 European Pat. Off. .

*Primary Examiner*—Vit W. Miska
*Attorney, Agent, or Firm*—Graham & James

[57] ABSTRACT

A waveform-forming device has a waveform memory storing a plurality of blocks of waveform samples representative of a waveform of a musical tone. Each block is formed of at least one non-compressed waveform sample and a plurality of compressed waveform samples. A pitch of a musical tone to formed is taken in. The waveform samples are read out block by block from the waveform memory, based on the pitch taken in. The compressed waveform samples contained in each block are converted into non-compressed waveform samples. The waveform of the musical tone is formed from the at least one non-compressed waveform sample of each block and the non-compressed waveform samples obtained by the conversion.

10 Claims, 17 Drawing Sheets

20
Wb
OUTPUT : D0
16 BIT-DATA
6 BIT-DATA
OUTPUT : D1~D8
54
TIMING ADJUSTING CIRCUIT
52
Sn
SELECTOR
I1:D1
I2:D2
I3:D3
I4:D4
I5:D5
I6:D6
I7:D7
I8:D8
51
S1
LATCH
0-5
6-11
0-1
2-7
8-13
0-3
4-9
10-15
0-15
12-15
14-15
DELAY
53
12-15
Wa
16 BITS
0-15

WAVEFORM-FORMING DEVICE HAVING MEMORY STORING NON-COMPRESSED/COMPRESSED WAVEFORM SAMPLES

BACKGROUND OF THE INVENTION

1. Field of the Invention

This invention relates to a waveform-forming device which is-equipped with a waveform memory storing waveform sample data.

2. Prior Art

Conventionally, waveform-forming devices which are equipped with a waveform memory storing digitalized data of waveform samples of musical tones are used in PCM tone generators of electronic keyboard instruments and the like. The digital data of waveform samples which are stored in the waveform memory are prepared by sequentially sampling waveforms of a predetermined musical tone at given sampling points, and converting values of amplitude of the waveforms sampled at respective sampling points into digital data (the digital data is hereinafter referred to as "a waveform sample"). A musical tone is reproduced by sequentially reading out the waveform samples corresponding to the musical tone from the waveform memory. To make efficient use of the waveform memory, the amplitude value of the waveform sample at each sampling point is not directly digitized into a so-called PCM format, but is formed into a compressed data format. Various types of compressed data format have already been proposed.

Conventionally proposed compressed data-forming methods include a so-called DPCM method which comprises determining a difference between each waveform sample and the following waveform sample and storing the determined difference into the waveform memory. According to the DPCM method, first, a waveform sample of non-compressed type (hereinafter referred to as "non-compressed waveform sample") is stored, and then a difference between each stored waveform sample and the following waveform samples is sequentially stored into the waveform memory, to thereby obtain compressed waveform samples. In reproducing waveform samples before compression from the compressed waveform samples, first, the non-compressed waveform sample is directly reproduced, then the non-compressed waveform sample and a first one of the above-mentioned differences stored are added together to reproduce a second waveform sample, and the second waveform sample thus reproduced and a second one of the differences are added together to reproduce a third waveform sample, and so forth. Thus, waveform samples are reproduced by adding together each waveform sample to be reproduced and the immediately preceding one reproduced.

More specifically, waveform sample data are read from the waveform memory in the following manner: First, frequency information or data on the frequency (what is called "F number") corresponding to the pitch of a musical tone to be produced is sequentially cumulated or counted by an accumulator to sequentially output a count value qF (q=1, 2, 3 . . . ). The integer part I of the count value is used as an address for access to each waveform sample to read data from the waveform memory at a predetermined frequency. If the predetermined sampling frequency is constant irrespective of waveforms of a musical tone to be reproduced, the count value qE has a positive real number having a decimal fraction d. Therefore, a waveform reproduced from data read out by using only each integer part as an address is not faithful to a desired waveform of the musical tone. To overcome this inconvenience, a plurality of waveform samples adjacent or close to a waveform sample at an address location of the waveform memory corresponding to the integer part I are read from the waveform memory, and an interpolation is carried out on the waveform samples by the use of the decimal fraction d to reproduce the interpolated waveform samples.

However, waveforms of a musical tone which are different only in pitch from waveforms stored in the waveform memory cannot be reproduced by reading out waveform sample data from every address in the waveform memory, but it is required to read waveform samples by skipping over every number of addresses corresponding to the pitch of the musical tone (skip access), as is so called "pitch-up" According to the conventional waveform-forming device described above, in which each waveform stored in the waveform memory is formed of one non-compressed waveform sample and a plurality of waveform samples indicative of differences between adjacent waveform samples, to form or reproduce a waveform, it is always required to add a waveform sample of the difference to an immediately preceding waveform sample data reproduced, starting with reproduction of a first non-compressed waveform sample This imposes a limitation upon the "pitch-up width" i.e. the amount by which the pitch of a musical tone to be formed from the waveform sample can be increased. Because of this limitation, it should be avoided to use the same waveform sample over a wide sound range by increasing the pitch-up width, but it is required to store lots of data of waveform samples of an identical timbre corresponding to respective different pitches by increasing the capacity of the waveform memory, which results in increased manufacturing costs.

Further, the limitation upon the pitch-up width also makes it impossible to follow up variations in the pitch due to,operation of a pitch envelope generator (EG) employed in the waveform-forming device.

An electronic musical instrument has been proposed by U.S. Pat. No. 4,916,996, which has a waveform memory storing compressed waveform data prepared by an ADPCM method, and wherein data are read from the waveform memory to generate a musical tone. According to the proposed musical instrument in repeatedly reading out a specific portion of waveforms of a musical tone, sample data reproduced from the start of the specific portion (which is obtained by converting differential sample data into linear sample data) is storied, and subsequently repeated reading-out is carried out by the use of the stored reproduced sample data as an initial value to thereby form the waveform of the musical tone.

However, the proposed electronic musical instrument also has the above described inconvenience that data cannot be read out from the waveform memory by skip access or "pitch-up".

SUMMARY OF THE INVENTION

It is the object of the invention to provide a waveform-forming device which is capable of increasing the pitch-up Width without increasing the capacity of the waveform memory, and can be manufactured at a reduced cost.

To attain the above object, according to a first aspect of the present invention, there is provided a waveform-forming device for forming waveforms of musical tones, comprising:

waveform memory means for storing a plurality of blocks of waveform samples representative of a waveform of a musical tone, each block being formed of at least one non-compressed waveform sample and a plurality of compressed waveform samples;

reading means for reading the waveform samples block by block, from the waveform memory means, based on a pitch of a musical tone to be formed;

converting means for converting the compressed waveform samples contained in each block, read by the reading means, into non-compressed waveform samples; and waveform-forming means for forming the waveform of the musical tone from the at least one non-compressed waveform sample of the each block and the non-compressed waveform samples obtained by the converting means.

Preferably, the waveform-forming device further comprises pitch-designating means for designating the pitch of the musical tine to be formed.

More preferably, the reading means reads out the waveform samples at a frequency irrespective of a frequency of a waveform to be formed, and the device further comprises:

interpolating means for performing interpolation on the non-compressed waveform samples contained in the each block and obtained by conversion of the converting means, to form the waveform of the musical tone, a number at least $m-1$ of waveform samples located at a tail portion of the each block being identical with a number at least $m-1$ of waveform samples located at a head portion of an immediately subsequent block thereof, when the interpolating means performs interpolation by the use of a number m of waveform samples.

According to a second aspect of the invention, there is provided a waveform-forming device for forming waveforms of musical tones, comprising:

waveform memory means for storing non-compressed waveform samples located at intervals of a predetermined number of sampling points, and compressed waveform samples each located between adjacent ones of the non-compressed waveform samples;

frequency information-generating means for generating information on a frequency corresponding to a pitch of a musical tone to be formed;

cumulating means for cumulating the frequency information at a predetermined speed to output a cumulative value;

reading means for reading, based on the cumulative value, a non-compressed waveform sample and a plurality of compressed waveform samples subsequent to the non-compressed waveform sample, from the waveform memory means; and converting means for converting the plurality of compressed waveform samples read by the reading means into non-compressed waveform samples using the non-compressed waveform sample.

Preferably, the waveform-forming device further comprises:

selecting means for selecting, based on the cumulative value, non-compressed waveform samples to be used for interpolation, out of the non-compressed waveform sample and the plurality of non-compressed waveform samples.

Also preferably, the waveform-forming device further comprises:

interpolating means for performing interpolation, based on the cumulative value, on non-compressed waveform samples selected by the selecting means, to output a result of the interpolation as a waveform sample of a musical tone.

According to a third aspect of the invention, there is provided a waveform-forming device for forming waveforms of musical tones, comprising:

waveform memory means storing non-compressed waveform samples located at intervals of a predetermined number of sampling points, and compressed waveform samples each located between adjacent ones of the non-compressed waveform samples;

frequency information generating means for generating information on a frequency corresponding to a pitch of a musical tone to be formed;

cumulating means for cumulating the information at a predetermined speed to output a cumulative value;

reading means for reading, based on the cumulative value, a plurality of non-compressed waveform samples and compressed waveform samples sequentially arranged from the waveform memory means;

converting means for converting the compressed waveform samples read by the reading means into non-compressed waveform samples in a manner such that the compressed samples are converted by the use of an immediately preceding one of the non-compressed waveform samples;

selecting means for selecting, based on the cumulative value, non-compressed waveform samples to be used for interpolation, out of the non-compressed waveform samples obtained by reading means and the non-compressed waveform samples obtained by the converting means; and interpolating means for performing interpolation, based on the cumulative value, on non-compressed waveform samples selected by the selecting means, to output results of the interpolation as a waveform of a musical tone.

According to a fourth aspect of the invention, there is provided a waveform-forming device for forming a waveform of a musical tone, comprising:

waveform memory means for storing non-compressed waveform samples located at intervals of a predetermined number of sampling points, and compressed waveform samples each located between adjacent ones of the non-compressed waveform samples;

converting means for converting the compressed samples into non-compressed waveform-samples by the use of immediately preceding one of the non-compressed waveform samples; and tone forming means for forming a waveform of a musical tone in accordance with the non-compressed waveform samples converted by the converting means and the non-compressed waveform samples stored in the waveform memory means.

According to a fifth aspect of the invention, there is provided a method of forming waveforms of musical tones comprising the steps of:

a step for storing a plurality of blocks of waveform samples representative of a waveform of a musical tone, each block being formed of at least one non-compressed waveform sample and a plurality of compressed waveform samples;

a step for designating a pitch of a musical tone to be formed;

a step for reading the waveform samples block by block, based on the designated pitch;

a step for converting the compressed waveform samples contained in each block, read by the reading means, into non-compressed waveform samples; and a step for forming the waveform of the musical tone from the at least one non-compressed waveform sample of the each block and the non-compressed waveform samples obtained by the converting means.

According to a sixth aspect of the invention, there is provided a method of forming waveforms of musical tones comprising the steps of:

a step for storing non-compressed waveform samples located at intervals of a predetermined number of sampling points, and compressed waveform samples each located between adjacent ones of the non-compressed waveform samples;

a step for generating information on a frequency corresponding to a pitch of a musical tone to be formed;

a step for cumulating the frequency information at a predetermined speed to output a cumulative value;

a step for reading, based on the cumulative value, a non-compressed waveform sample and a plurality of compressed waveform samples subsequent to the non-compressed waveform sample; and a step for converting the plurality of compressed waveform samples read by the reading means into non-compressed waveform samples using the non-compressed waveform sample.

The above and other objects, features, and advantages of the invention will become more apparent from the following detailed description taken in conjunction with the accompanying drawings.

DETAILED DESCRIPTION

The invention will now be described in detail with reference to drawings showing preferred embodiments thereof.

Figure 1:
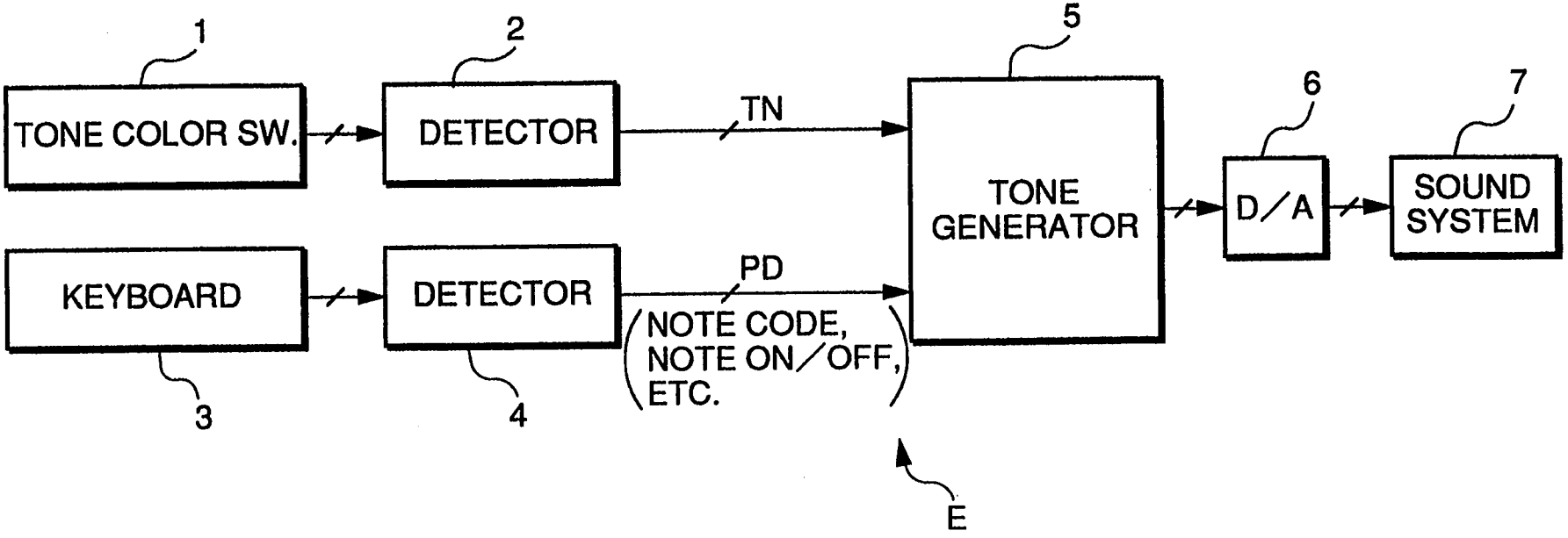
FIG. 1 is a block diagram schematically showing the arrangement of an electronic keyboard instrument incorporating a waveform-forming device according to the invention.

FIG. 1 schematically shows the whole arrangement of an electronic keyboard instrument incorporating a waveform-forming device according to the invention.

The electronic keyboard instrument, generically designated by reference symbol E, comprises a tone color switch 1 by which tone colors to be generated by the electronic keyboard instrument are selected, a tone color-setting detector 2 which detects the status of the tone color switch 1, a keyboard 3, a key status detector 4 for detecting a key-on or a key-off state of each key on the keyboard 3, a tone generator (waveform-forming device) 5 which generates a digital musical tone signal indicative of waveforms of a musical tone to be produced by the instrument E, based on a tone color number TN output from the tone color-setting detector 2, a D/A converter for converting the digital musical tone signal into an analog signal, and a sound system 7 including loudspeakers, etc. for generating musical tones corresponding to an output from the D/A converter 6.

Figure 2A:
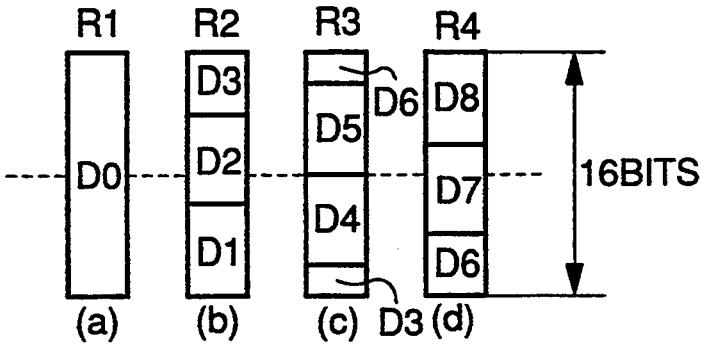
FIG. 2A is a diagram showing a data format of waveform samples stored in a waveform memory as a component part of the waveform-forming device according to the invention.
Figure 2B:
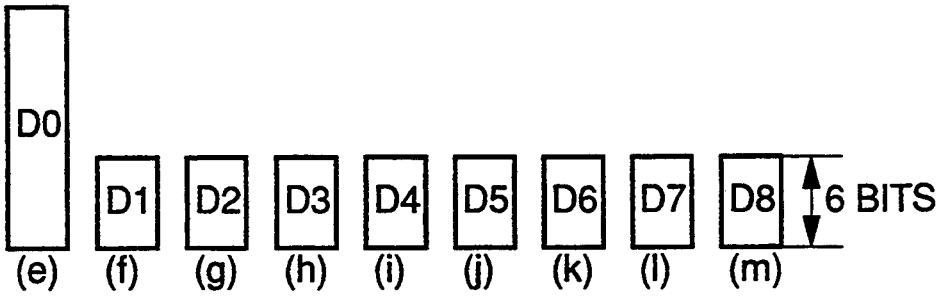
FIG. 2B is a diagram showing nine waveform samples obtained by dividing the waveform samples appearing in FIG. 2A.
Figure 2C:
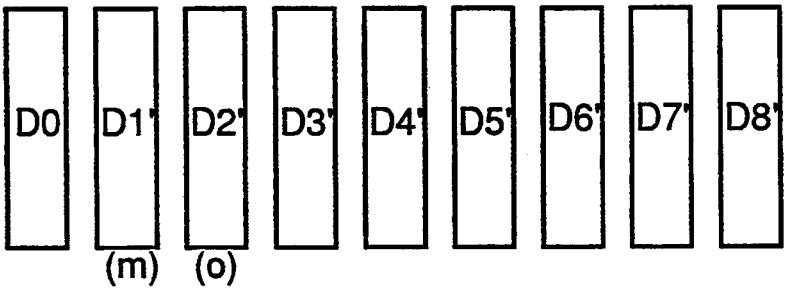
FIG. 2C is a diagram showing waveform samples obtained by decoding the divided waveform samples shown in FIG. 2B.
Figure 2D:
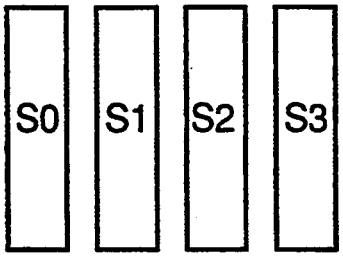
FIG. 2D is a diagram showing four successive waveform samples selected from the decoded waveform samples.

FIG.. 2A to FIG. 2D illustrate how compressed waveform samples of a waveform of a musical tone stored in a waveform memory, which will be described in detail hereinbelow, of the tone generator 5, are processed into a form for reproduction.

In the present embodiment, the waveform memory stores a number of blocks of waveform sample data. Each block of waveform sample data comprises nine waveform samples. That is, as shown in FIG. 2A, the block comprises a non-compressed waveform sample (a) (hereinafter referred to as "the linear sample") D0 having a data length of 16 bits and waveform samples (b) to (d) each having a data length of 16 bits, each formed by two entire compressed waveform samples and at least one fraction of compressed waveform samples (hereinafter referred to as "the compressed samples") D1 to D8, each compressed sample having a data length of 6 bits. Musical tone data are read out in blocks from the waveform memory. To make efficient use of the memory, the compressed samples D1 to D8 are stored in the memory area with no space therebetween, as shown in (b) to (d) of FIG. 2A.

FIG. 2B shows waveform samples obtained after separation by a data separator, referred to hereinafter. In the figure, a first waveform sample (e) corresponds to the waveform sample (a) or the linear sample D0 shown in FIG. 2A, a second waveform sample (f) to the compressed sample D1 formed by a lower 6-bit fraction of the waveform sample (b) in FIG. 2A, and a fourth waveform sample (h) to the compressed sample D3 formed by an upper 4-bit fraction of the waveform sample (b) and a lower 2-bit fraction of the waveform sample (c).

FIG. 2C shows waveform samples ready for reproduction after expansion of the separated waveform samples in FIG. 2B by a decoder described hereinafter (hereinafter referred to as "the calculated linear samples"). In the figure, a calculated linear sample D1' at (n) is formed by adding an expanded sample from the compressed sample D1 or (f) in FIG. 2B to the linear sample D0 or (e) in FIG. 2B, and a calculated linear sample D2' or (o) by adding an expanded sample from the compressed sample D2 or (g) in FIG. 2B to the calculated linear sample D1'.

Figure 3:
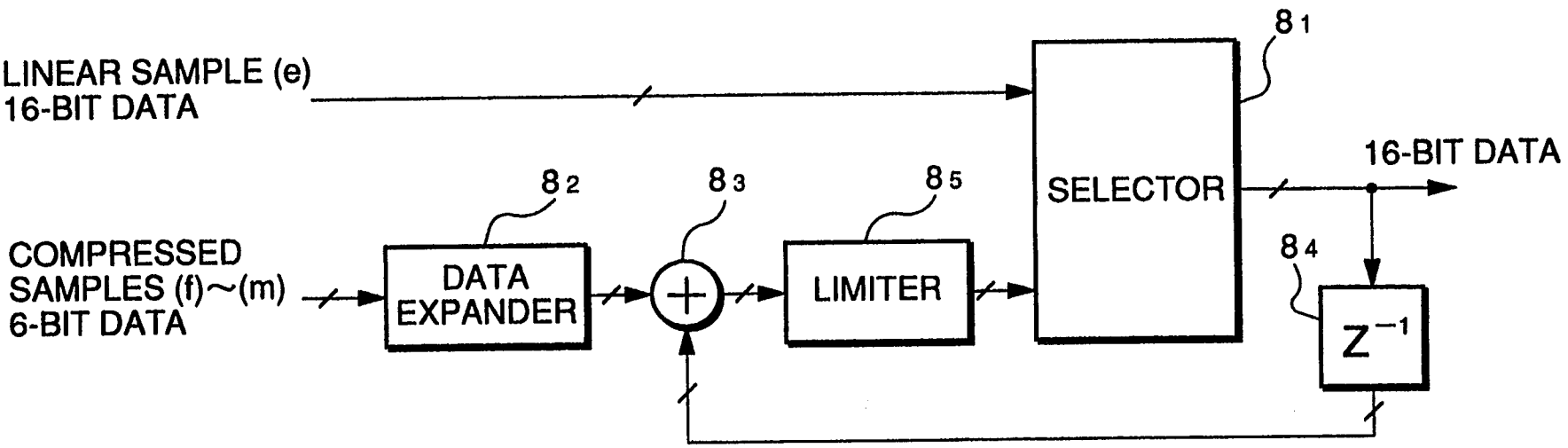
FIG. 3 is a diagram showing the principle of processing for reproducing original non-compressed waveform samples from the divided waveform samples.

FIG. 3 shows the principle of waveform data-processing carried out for reproduction of waveform samples from compressed samples shown in FIG. 2B. As shown in the figure, the linear sample (e) in FIG. 2B is directly input to one input terminal of a selector $\mathbf{8_1}$. On the other hand, the compressed samples (f) to (m) are sequentially expanded to 16-bit data by a data expander $\mathbf{8_2}$ formed of a data expansion table, and applied to an adder $\mathbf{8_3}$, where the expanded waveform samples are added to output values from a delay circuit $\mathbf{8_4}$, and the resulting data are supplied via a limiter $\mathbf{8_5}$ to the other input terminal of the selector $\mathbf{8_1}$.

For example, the compressed sample D1 at (f) is expanded to a 16-bit waveform sample by the data expander $\mathbf{8_2}$ and applied to the adder $\mathbf{8_3}$, where the expanded 16-bit waveform sample from the compressed sample D1 and an output value from the selector $\mathbf{8_1}$, i.e. the linear sample DO are added together to form a calculated linear sample D1' shown at (n) of FIG. 2C. Similarly, the compressed sample D2 at (g) is expanded by the data expander 82 and applied to the adder 83, where the expanded data from the compressed sample D2 and the calculated linear sample D1' are added together to form a calculated linear sample D2' shown at (o) of FIG. 2C.

In addition, the waveform memory stores not only those blocks containing compressed samples described above, but also blocks containing only linear samples.

FIG. 2D shows four calculated linear samples which are output from a four data-output circuit, described hereinafter and supplied to an interpolation circuit, also described hereinafter. The four calculated linear samples are sequentially selected from the nine calculated linear samples shown in FIG. 2C.

Figure 4:
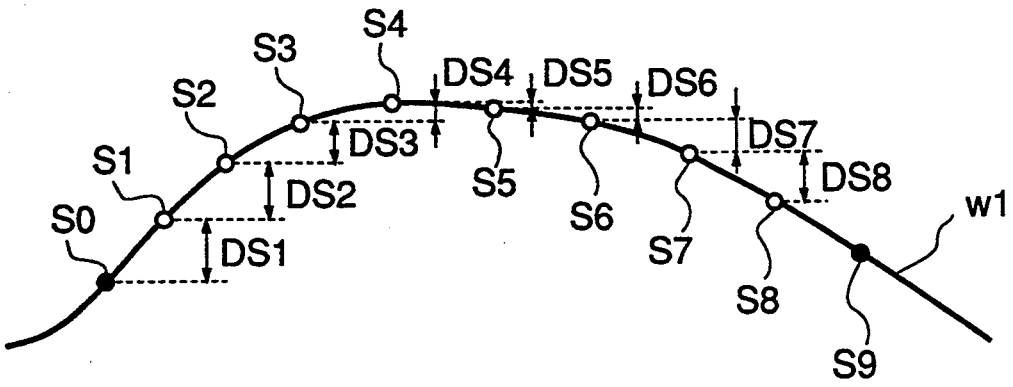
FIG. 4 is a diagram showing the relationship between waveform samples shown in FIG. 2A and the original waveform of the musical tone.

FIG. 4 shows the relationship between waveform samples stored in the waveform memory as shown in FIG. 2A and an original waveform of a musical tone from which these waveform samples are prepared. w1 designates the waveform of the musical tone which is sampled, and S0 to S8 designate sampling points at which the waveform is sampled. Linear samples are obtained at sampling points S0 and S9 shown in black dots, whereas compressed samples are obtained at sampling points S1 to S8 shown in circles.

For example, let it be assumed that the linear sample obtained at the sampling point S0 corresponds to the linear sample D0 shown in FIG. 2A. The compressed sample obtained at the following sampling point S1 indicates a difference DS1 in amplitude between the sampling point S0 and S1. Similarly, the compressed samples D2 to D8 at the following sampling points D2 to D8 indicate differences DS2 to DS8 in amplitude between present sampling points S2 to S8 and the respective immediately preceding sampling points.

Figure 5A:
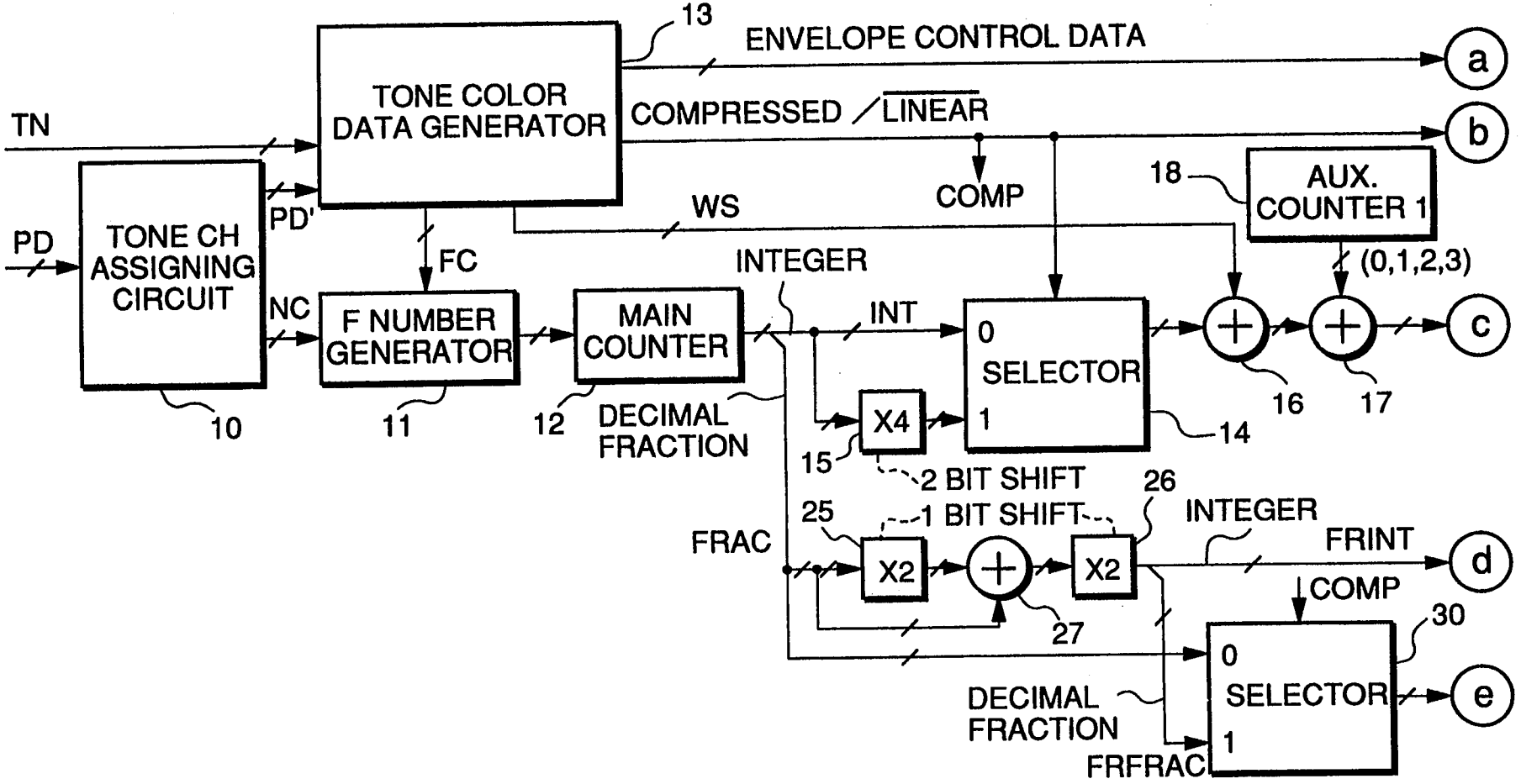
FIG. 5A is a block diagram showing part of the arrangement of a waveform-forming device according to a first embodiment of the invention.
Figure 5B:
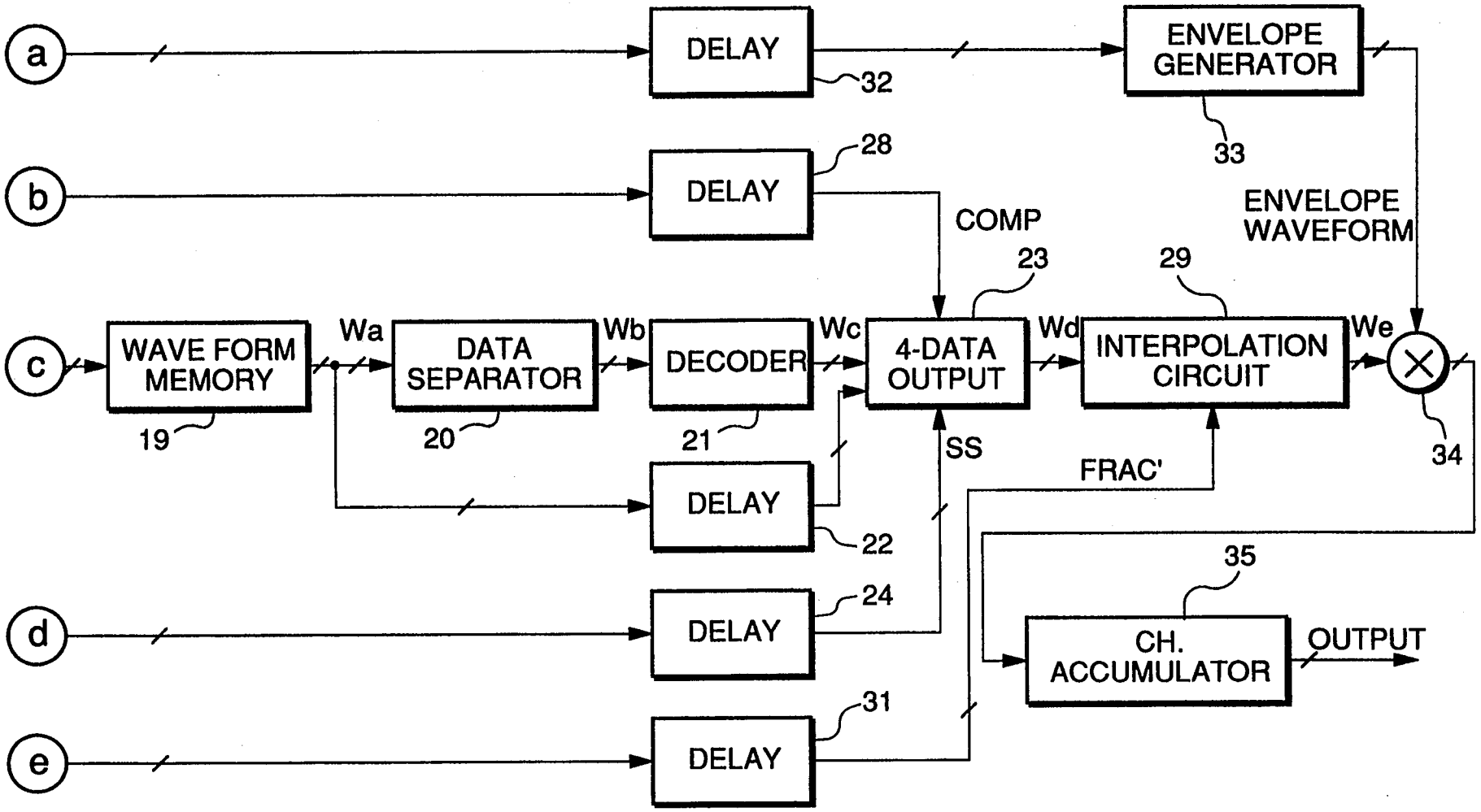
FIG. 5B is a block diagram showing the remaining part of the arrangement of the waveform-forming device.

FIG. 5A, and FIG. 5B show the construction of the tone generator 5 appearing in FIG. 1.

Performance data PD from the keyboard 3 appearing in FIG. 1 are supplied to a tone channel-assigning circuit 10. In general, a tone generator of an electronic musical instrument is operated by time division to produce a plurality of sounds from one circuit. Therefore, the tone channel-assigning circuit 10 assigns the performance data to time slots obtained by time division. For the sake of simplicity, the following description deals with processing of performance data PD' of the performance data PD, which is assigned to one time slot.

The tone channel-assigning circuit 10 has an output thereof connected to an F number generator 11 and a tone color data generator 13. A note code NC as part of the performance data PD' indicative of the pitch of a musical tone to be produced is supplied to the F number generator 11, as well as to the tone color data generator 13.

The F number generator 11 stores values of the F number proportional to frequencies of note codes NC indicative of pitches of musical tones, and outputs an F number value corresponding to a note code NC input thereto. When a waveform of a musical tone is generated at a predetermined frequency irrespective of the frequency of a musical tone to be synthesized (i.e. by the so-called pitch-asynchronous or fixed DAC cycle), the F number should be in the form of a numerical value having an integer and a decimal fraction, which value is determined by the ratio of the frequency indicated by the input note code NC to the sampling frequency of the waveform samples stored in the waveform memory 19, at which the waveform samples were prepared. Accordingly, the F number generator 11 is supplied from the tone color data generator 13 with a signal FC which indicates information on the sampling frequency of selected ones of the waveform samples stored in the waveform memory 11. Thus, the F number generator 11 outputs an F number value corresponding to the signal FC and the input note code NC.

The F number generator 11 has an output thereof connected to an input of a main counter 12, which cumulatively counts F number values sequentially input thereto and outputs a count value qF (q=1, 2, 3, . . . ). That is, the count value qF from the main counter 12 is proportional to the frequency of the musical tone indicated by the note code NC. As is generally known, the count value qF is a positive real number.

The tone color data generator 13 is supplied with the performance data PD' from the tone channel-assigning circuit 10, as well as the tone color number TN from the tone color-setting detector 2 in FIG. 1, as mentioned before. The tone color data generator 13 generates, in response to these input signals, envelope control data EC for controlling the envelope of the waveform of a musical tone to be produced, a signal COMP indicative of whether each selected waveform sample is a compressed sample or a linear sample, a waveform start address WS indicative of the start address location of each selected block of waveform samples within the waveform memory 19, described hereinafter, and the aforementioned signal FC. The signal COMP assumes a high "H" level when the selected waveform sample is a compressed sample, whereas it assumes a low "L" level when the selected waveform sample is a linear sample.

The output value qF from the main counter 12 is a positive real number, as mentioned above, from which are separately taken out a signal INT indicative of an integer thereof corresponding to one waveform sample to be read out and a signal FRAC indicative of a decimal fraction thereof. The signal INT is supplied via two branch paths, i.e. one directly leading to an input terminal of a selector 14 and one extending through a two-bit shift circuit 15 where the signal INT is multiplied by a factor of 4, to the other input terminal of the selector 14. Further, the selector 14 is supplied with the signal COMP, and allows the input signal INT to pass therethrough when the signal COMP is at "L" level (0), and outputs a signal obtained by multiplying the signal INT by a factor of 4 when the signal COMP is at "H" level (1).

The selector 14 has an output thereof connected to one input terminal of an adder 16, which is supplied with the aforementioned waveform start address WS via the other input terminal thereof, to add the start address WS to the input value from the selector 14. That is, the adder 16 determines the start address of a block of waveform samples to be read out from the waveform memory 19, based on the pitch of the musical tone indicated by the note code NC.

The adder 16 has an output thereof connected to one input terminal of an adder 17, which has the other input terminal thereof connected to an output of an auxiliary counter 18. The auxiliary counter 18 is used to read out waveform samples from the waveform memory 19 and outputs an integer from 0 to 3. More specifically, when a block containing compressed samples is indicated by the adder 16, the auxiliary counter 18 outputs "0" to read out a linear sample, and the integers from 1 to 3 to read out compressed samples. The adder 17 sequentially adds the count value from the auxiliary counter 18 to the address indicated by an output from the adder 16, to output a sequence of four addresses for reading out the waveform samples of one block from the waveform memory 19.

The adder 17 has an output thereof connected to an input of the waveform memory 19 to supply the same with a sequence of four addresses for reading out waveform samples therefrom.

The waveform memory 19 has an output thereof connected to an input of a data separator 20 as well as to an input of a delay circuit 22.

Figure 6:
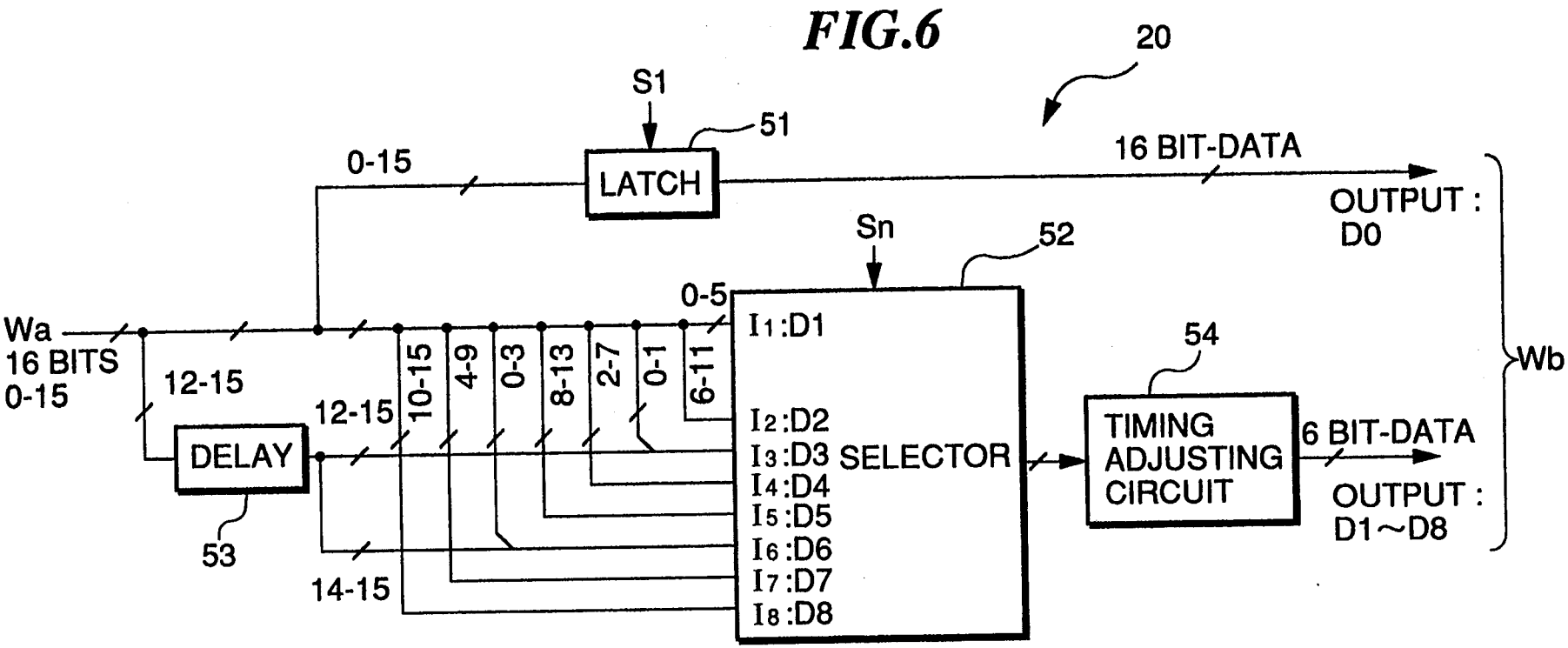
FIG. 6 is a block diagram showing the construction of a data separator appearing in FIG. 5B.

FIG. 6 shows the construction of the data separator 20. The data separator 20 operates such that in the example of FIG. 2A and FIG. 2B, the linear sample D0 is allowed to directly pass therethrough and the compressed samples D1 to D8 are separated into 6-bit data, as previously described with reference to FIG. 2A and FIG. 2B. As shown in FIG. 6, the data separator 20 is comprised of a latch circuit 51, a selector 52, a delay circuit 53, and a timing adjuster 54. A waveform sample having a full data length (bits Nos. 0 to 15) from the waveform memory 19, i.e. the linear sample D0 at (a) of FIG. 2A is supplied to the latch circuit 51, which, in response to a selector signal S1, delivers the latched data to a decoder 21, described hereinbelow.

On the other hand, the selector 52 has input terminals I1 to I8 to which are supplied data bits corresponding to the compressed samples D1 to D8 of the waveform samples (b) to (d) in FIG. 2A. For example, the input terminal I1 is supplied with data of bits Nos. 0 to 5, i.e. the compressed sample D1 of in the waveform sample (b), and the input terminal I3 is supplied via the delay circuit 53 with data of bits Nos. 12 to 15 and directly with data of bits Nos. 0 to 1, i.e. the compressed sample D3 separately contained in the waveform samples (b) to (c).

Similarly, data bits corresponding to the other compressed samples are supplied to the other input terminals of the selector 52. In this manner, the delay circuit 53 delays a portion of a compressed sample such as D3 and D6 contained in two adjacent waveform samples such that a portion contained in the preceding waveform sample is delayed and applied together with the rest of the compressed sample contained in the following waveform sample to the selector 52 at the same time.

The selector 52 operates on a select signal Sn input thereto to sequentially deliver the compressed samples D1 to D8 to the timing adjuster 54. The timing adjuster 5 equalizes the intervals of time slots of the samples D1 to D8 which have been input by time division from the selector 52.

The tone generator 5 in FIG. 1 has a system clock generator, not shown, which generates system clock pulses required in controlling the overall operation of the whole system. The system clock pulses are supplied to a timing signal generator, not shown, which generates various timing signals based on the system clock pulses, including the aforementioned signals S1 and Sn.

Referring again to FIG. 5B, the data separator 20 has an output thereof connected to an input of the decoder 21. The linear sample and the compressed samples adjusted in timing by the timing adjuster 54 are sequentially supplied to the decoder 21 as a signal Wb.

The decoder 21 operates on the input signal Wb to reproduce the compressed samples to linear samples, as described before with reference to FIG. 2C.

Figure 7:
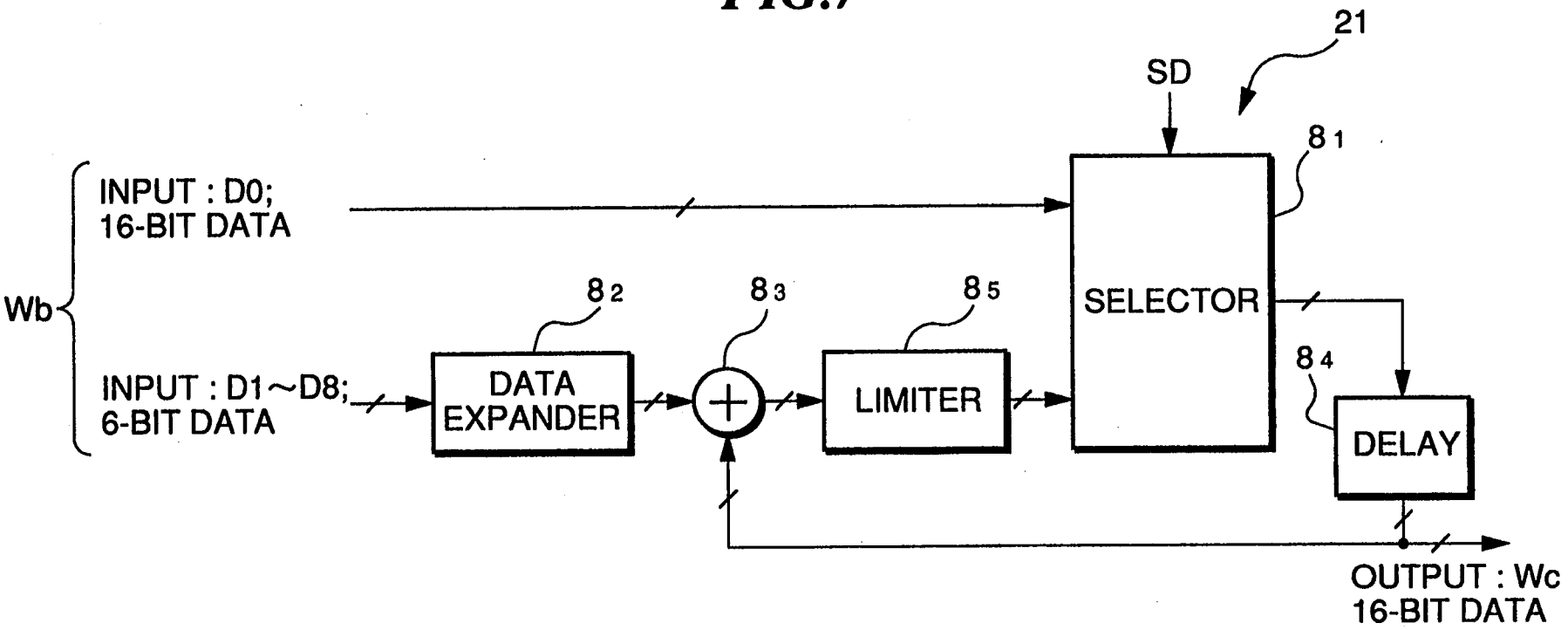
FIG. 7 is a block diagram showing the construction of a decoder appearing in FIG. 5B.

FIG. 7 shows the construction of the decoder 21. This figure is substantially identical with FIG. 3 showing the principle of processing for reproducing original non-compressed waveform samples. Therefore, in FIG. 7, corresponding elements and parts to those in FIG. 3 are designated by identical reference numerals, and detailed description thereof is omitted.

As already described with reference to FIG. 3, the linear sample DO of the signal Wb from the data separator 20 is directly supplied to one input terminal of a selector $\mathbf{8_1}$, whereas the compressed samples D1 to D8 are sequentially expanded to 16-bit data by a data expander $\mathbf{8_2}$, and then applied to an adder $\mathbf{8_3}$ where each of them is added to the immediately preceding signal supplied via a delay circuit $\mathbf{8_4}$ from the selector $\mathbf{8_1}$. The resulting sum is applied via a limiter $\mathbf{8_5}$ to the other input terminal of the selector $\mathbf{8_1}$. The selector $\mathbf{8_1}$ outputs one of the two input signals according to the select signal supplied from the timing generator. The output signal from the selector $\mathbf{8_1}$ is supplied to the delay circuit $\mathbf{8_4}$, from which the output signal is supplied via two branch paths, i.e. the signal via one path is fed back to the adder $\mathbf{8_3}$ and the signal via the other path is output as a signal Wc.

Referring again to FIG. 5B, the decoder 21 has an output thereof connected to one input terminal of a 4-data output circuit 23. The 4-data output circuit 23 has the other input terminals thereof connected, respectively, to an output of the aforementioned delay circuit 22 and outputs of delay circuits 24, 28, described hereinafter. The output signal Wc from the decoder 21 is supplied to the 4-data output circuit 23 together with the output signal Wa of the linear sample read from the waveform memory 19 and delayed by the delay circuit 22. Further, the 4-data output circuit 23 is supplied with a signal indicative of an integer FRINT obtained by multiplying the aforementioned decimal fraction FRAC by a factor of 6, which signal is supplied via the delay circuit 24 as a delayed signal (hereinafter referred to as "the sample selecting signal") SS, as well as with the aforementioned signal COMP delayed by the delay circuit 28.

Next, description will be made as to the sample selecting signal SS.

As described hereinbefore, the count value of the main counter 12 is separated into an integer INT and a decimal fraction FRAC. The signal indicative of the decimal fraction FRAC is branched into two paths. The signal via one path is multiplied to a sixfold value by 1-bit shift circuits 25, 26 and an adder 27 and then supplied to the delay circuit 24. The signal via the other path is directly supplied to one input terminal of a selector 30. The decimal fraction FRAC multiplied to the sixfold value is separated into an integer FRINT obtained by carrying-over of the resulting value, and a decimal fraction FRFRAC. The integer FRINT is supplied via the delay circuit 24 as the sample selecting signal SS to the 4-data output circuit 23. The sample selecting signal SS is used, as described hereinafter, to take out four successive calculated linear samples from the nine calculated linear samples shown in FIG. 2C. On the other hand, the decimal fraction FRFRAC is input to the other input terminal of the selector 30. Further, the selector 30 is supplied with the signal COMP via a select terminal thereof. The selector 30 outputs the decimal fraction FRFRAC when the signal COMP is at "H" level, whereas it outputs the decimal fraction FRAC from the main counter 12 when the signal COMP is at "L" level.

The multiplication of the decimal fraction FRAC to its sixfold value to take out an integer FRINT from the sixfold value is based on the ground that the sample selective signal SS consists of six kinds, and therefore the sixfold value of the decimal fraction FRAC can be conveniently used to choose one of the six kinds of the selecting signal SS. More specifically, the decimal fraction of the FRAC ranges from 0 to 0.9 . . . , and when it is multiplied to a sixfold value, the resulting sixfold value ranges from 0 to 5.9 . . . and hence the integer thereof ranges from 0 through 5. Therefore, by assigning integers 0 through 5 to the six kinds of selecting signal SS, the 4-data output circuit 23 can output four successive calculated linear samples supplied to an interpolation circuit 29.

This processing of data is carried out to sequentially select four successive samples for interpolation from six possible combinations thereof in the present case where nine waveform samples are reproduced from each block of waveform samples containing the compressed samples. One block corresponds to addresses for reproducing six linear samples.

The output signal from the selector 30 is supplied to a delay circuit 31, and then supplied as a signal FRAC' to the interpolation circuit 29, described hereinafter.

Figure 8:
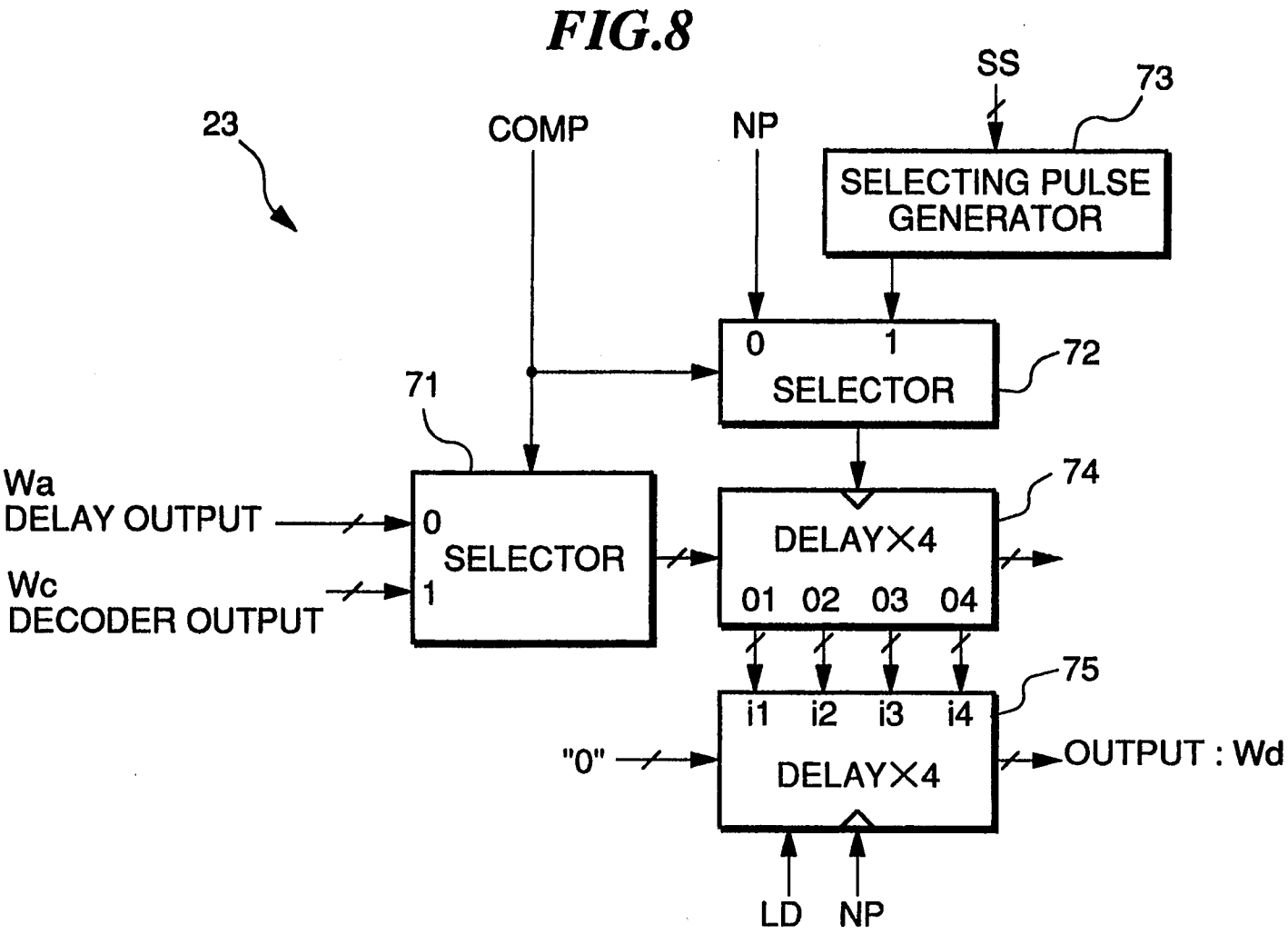
FIG. 8 is a block diagram showing the construction of a four data-output circuit appearing in FIG. 5B.

FIG. 8 shows details of the construction of the 4-data output circuit 23.

In the figure, the output Wc from the decoder 21 is supplied to one input terminal of a selector 71, while the delayed signal Wa is supplied to the other input terminal of the selector 71. Further, the selector 71 is supplied with the signal COMP via a select terminal thereof. The signal COMP is also supplied to a select terminal of a selector 72.

The selector 72 has one input terminal thereof supplied with a signal NP, referred to hereinafter, and the other input terminal supplied with one of six kinds of selecting signal pulses SP (each signal consisting of 4 pulses) generated by a selecting pulse generator 73, in response to the sample selecting signal SS.

The selector 71 has an output thereof connected to a data input terminal of a delay circuit 74 having a pulse take-in function. The selector 72 has an output thereof connected to a take-in pulse input terminal of the delay circuit 74.

The selector 71 selects, according to the signal COMP, the delayed data Wa when the data is to be derived from a linear sample, and the data WC from the decoder 21 when the data is to be derived from a compressed sample, and supplies the selected waveform sample to the delay circuit 74. The selector 72 supplies, according to-the signal COMP, the signal NP when the data is to be derived from a linear sample, and the sample selecting signal SS (selecting pulse train SP) to the delay circuit 74 when the data is to be derived from a compressed sample.

The delay circuit 74 operates in response to the output pulses from the selector 72 to supply a delay circuit 75 with four successive calculated linear samples selected by the selector 71 from the calculated linear samples D0, D1'–D8' in the decoder output Wc, and the waveform samples (a) to (d) (R1 to R4) in the delayed output Wa from the delay circuit 22. The delay circuit 75 also has a pulse take-in function, similarly to the delay circuit 74, and is further supplied with the signal NP as a clock for outputting the waveform data from the delay circuit 74 as, well as with a loading signal LD as pulses for determining the timing of taking in the four waveform samples and the timing of outputting the same. Responsive to the loading signal LD, the delay circuit 75 takes in the four waveform samples from the delay circuit 74, and outputs the four waveform samples as a signal Wd supplied to the interpolation circuit 26, in synchronism with the signal NP.

The signals LD and NP are generated from the timing signal generator, referred to before.

The present embodiment is applied to the so-called pitch-asynchronous type waveform-forming device which is adapted to form a waveform of a musical tone by processing waveform sample data at a fixed clock frequency irrespective of the frequency of the waveform of the musical tone to be generated. This type of waveform-forming device suffers from possible occurrence of non-harmonic aliasing noise in the frequency of the waveform generated. To eliminate the aliasing noise, it is required to carry out a four-point interpolation to generate one output waveform component from four calculated linear samples, referred to before. A six-point interpolation method similar to the four-point interpolation method has already been proposed in EP-A 0 273 447.

Further, as noted before, the present embodiment is constructed such that a waveform of a desired musical tone is formed only from one block of waveform samples. This is advantageous in that a plurality of blocks of data need not be read out to form a waveform of a musical tone, and hence the interpolation circuit can have a simple circuit configuration. Therefore, in applying the four-point interpolation method to the present embodiment, the last three of the waveform samples contained in one block read out are required to overlap with or have the same data as the first three of waveform samples contained in the following block read out. More specifically, according to the embodiment, one block of data-stored in the waveform memory contains nine waveform samples, with the last three of them being identical with the first three of waveform contained in the following block to be read out, and hence one block substantially corresponds to a memory area storing six waveform samples.

Figure 9:
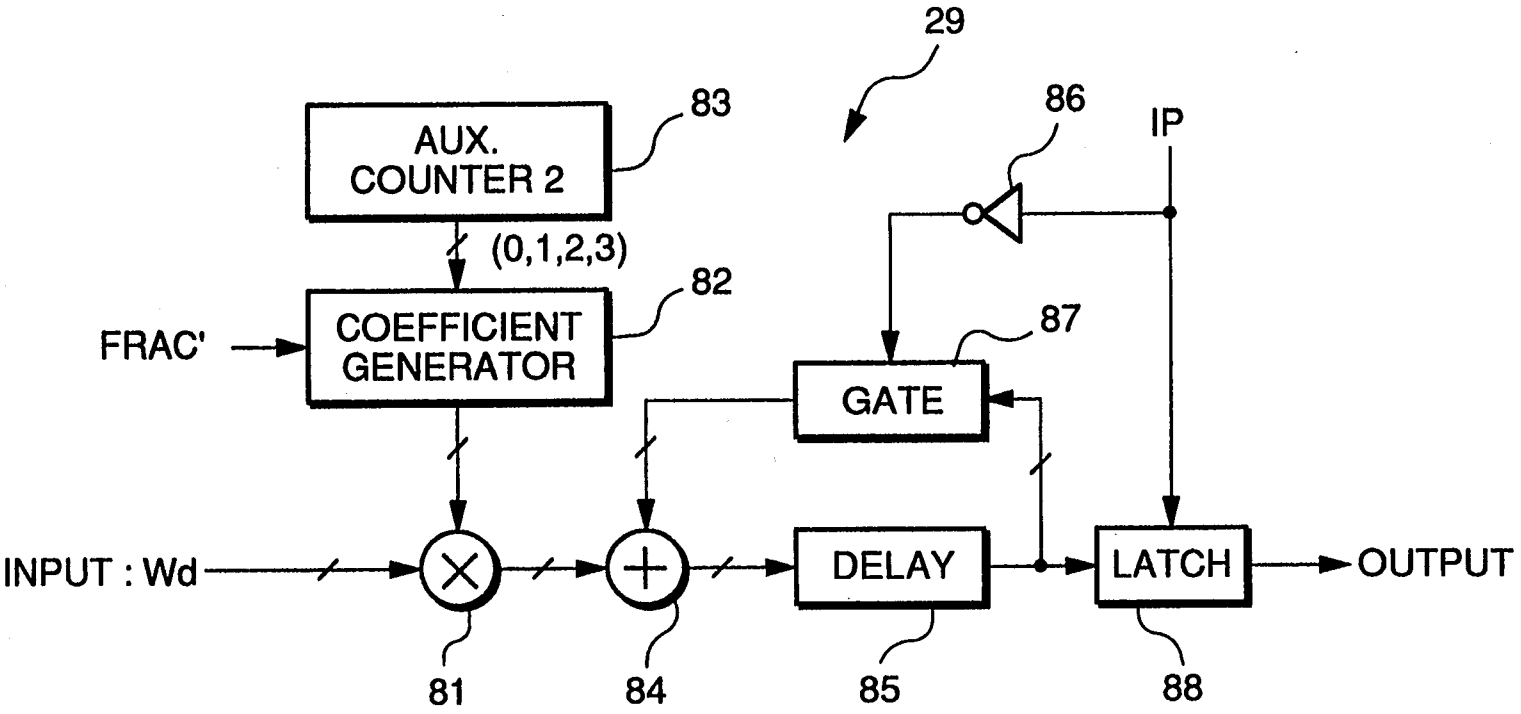
FIG. 9 is a block diagram showing the construction of an interpolation circuit appearing in FIG. 5B.

FIG. 9 shows the construction of the interpolation circuit 29.

In FIG. 9, the output signal Wd, i.e. a sequence of four waveform samples from the 4-data output circuit 23, is applied to one input terminal of a multiplier 81, which has the other input terminal supplied with an output from a coefficient generator 82. The coefficient generator 82 is supplied with the output signal FRAC' from the delay circuit 31 and an output from an auxiliary counter 83. Based on both the signals, a predetermined coefficient is selected, and then supplied to the multiplier 81 where the input signal Wd is multiplied by the coefficient. The multiplied input signal Wd is supplied to an adder 84. An output from the adder 84 is delayed by a delay circuit 85, and the delayed output is supplied to a gate 87 as well as to a latch circuit 88. Further, an interpolation timing signal IP generated from the timing signal generator is inverted by an inverter 86 and then applied to the gate 87, and directly to the latch circuit 88.

The first waveform sample S0 of the four waveform samples (referred to as S0, S1, S2, and S3, in the order formed) of the signal Wd is multiplied by a coefficient (hereinafter referred to as "$\alpha 1$") determined by an output value "0" from the auxiliary counter 83 and the signal FRAC', at the multiplier 81, and the resulting data $\alpha 1 \times$ S1 is supplied to the adder 84. At this time, the interpolation timing signal IP is at "H" level, and hence the gate 87 is closed. Accordingly, the data $\alpha 1 \times$ S1 is directly supplied to the delay circuit 85. Next, the waveform data S2 of the signal Wd is multiplied by a coefficient (hereinafter referred to as "$\alpha 2$") determined by an output value "1" from the auxiliary counter 83 and the signal FRAC', at the multiplier 81, and the resulting data $\alpha 2 \times$ S2 is supplied to the adder 84, where the data $\alpha 2 \times$ S2 is added to the data $\alpha 1 \times$ S1 delayed by the delay circuit 85, and the resulting data is again applied to the delay circuit 85. Thereafter, similarly, data $\alpha 3 \times$ S3 is added to $\alpha 1 \times$ S1 $+ \alpha 2 \times$ S2, and data $\alpha 4 \times$ S4 is added to $\alpha 1 \times$ S1 $+ \alpha 2 \times$ S2 $+ \alpha 3 \times$ S3. Thus, after the addition of all the waveform samples carried out in synchronism with the signal IP, the resulting data (hereinafter referred to as "interpolated sample We") is latched by the latch circuit 88 at a timing from the delay circuit 85, and the interpolated sample We is output from the latch circuit 88 upon rise of the signal IP.

Referring back to FIG. 5B, the interpolation circuit 29 has an output thereof connected to one input terminal of a multiplier 34, which has the other input terminal thereof connected to an envelope generator 33.

The interpolated sample We thus generated is multiplied at a multiplier 34 by an envelope waveform formed by the envelope generator 33 based on an envelope control waveform sample EC which is generated by the tone color data generator 13 and delayed by the delay circuit 32. The waveform samples thus produced by time division are accumulated by a channel accumulator 35 into accumulated data until such accumulated data of all the time division channels of one DAC cycle are obtained, and the accumulated data is supplied to the D/A converter 6 in FIG. 6 to be converted into an analog signal, which is then converted into a musical tone by the sound system 7.

Next, the operation of the waveform-forming device according to the present embodiment will be described with reference to FIG. 10A and FIG. 10B.

Figure 10A:
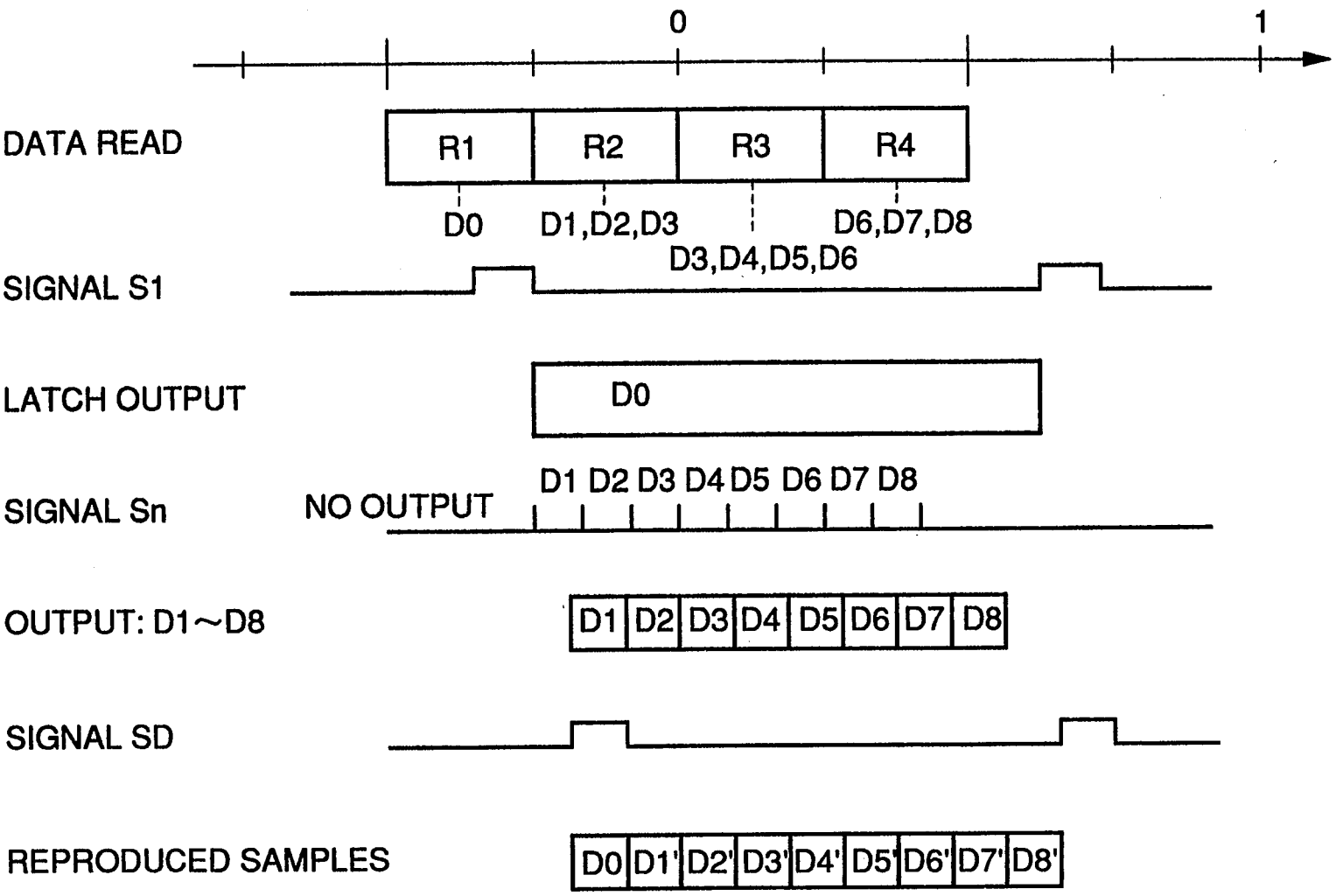
FIG. 10A is part of a timing chart which is useful in explaining the timing of data-processing operations carried out to convert one block of waveform samples read from the waveform memory into interpolated waveform data.
Figure 10B:
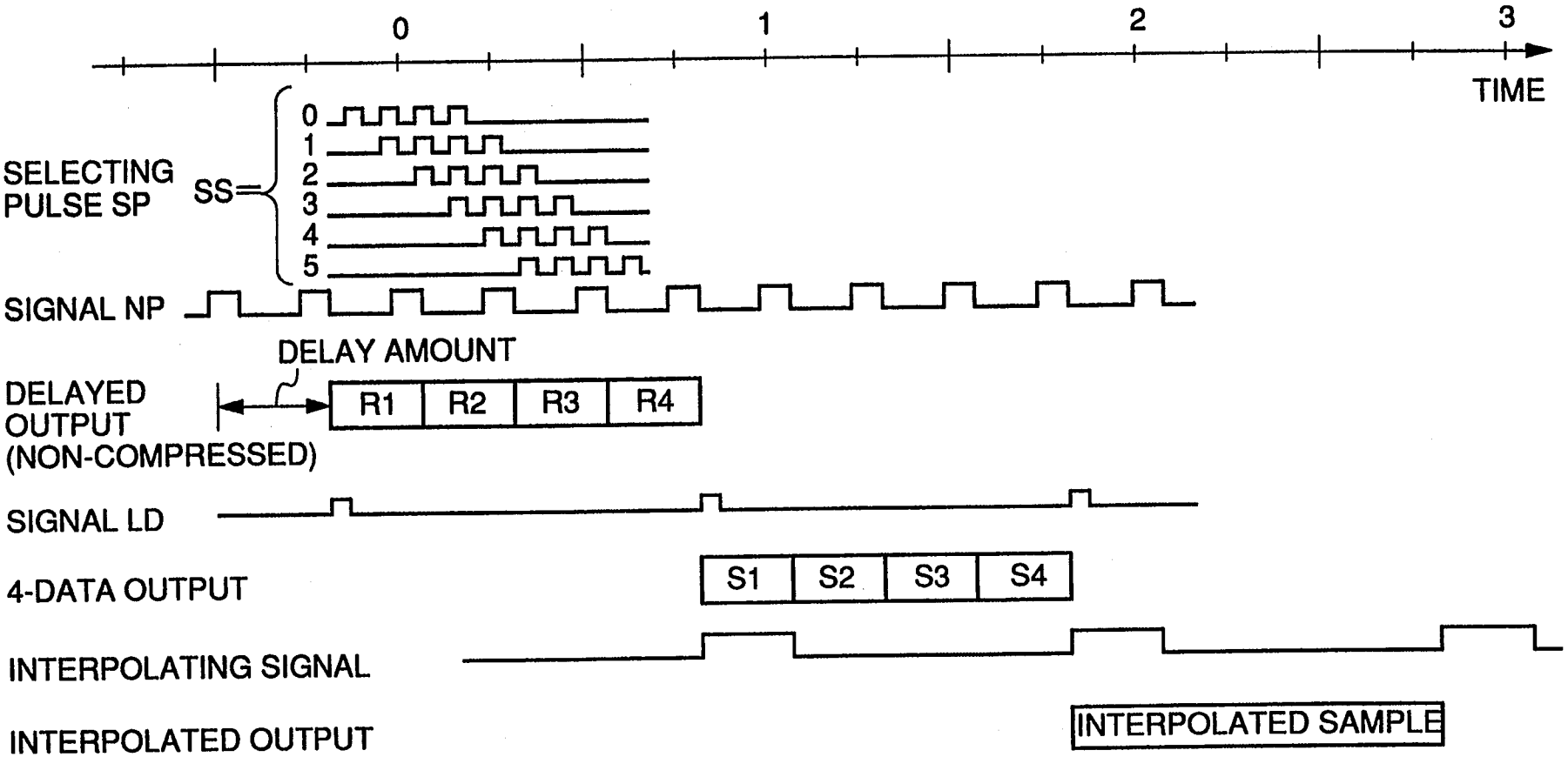
FIG. 10B is the remaining part of the timing chart of FIG. 10A.

FIG. 10A and FIG. 10B show the timing of data processing starting from the step of reading out four waveform samples of one block from the waveform memory 19 to the step of forming an interpolated sample We, as well as the timing of timing signals.

As described before, the waveform memory 19 in. FIG. 5A stores a number of blocks of waveform samples including blocks containing compressed samples, and those containing only linear samples. When the performance data PD and the tone color number TN are determined, the starting address of a waveform corresponding thereto is selected by the tone color data generator 13, and according to the selected starting address and the following data addresses, waveform samples containing compressed samples (COMP=1) and waveform samples containing no compressed samples (COMP=0) are sequentially read from the waveform memory 19.

First, description will be made separately of two cases: A first case in which the waveform samples of one block read out include compressed samples, and a second case in which the waveform samples of one block read out are formed solely by linear samples.

First, the first case will be explained:

When the performance data PD and the tone color number TN are determined, the performance data PD' is assigned to one of time slots provided by time division by the tone channel-assigning circuit 10 in FIG. 5A, then the performance data PD' is directly supplied to the tone color data generator 13, and the note code NC contained in the performance data PD ' is also supplied to the F number generator 11.

The tone color data generator 13 determines and supplies the signal FC to the F number generator 11 based on the performance data PD and the tone color number TN supplied thereto, to cause the F number generator 1 to supply the main counter 12 with a suitable F number based upon the note code NC. Thus, according to the F number, the main counter 12 carries out cumulative counting to output a count value. An integer INT of the count value is multiplied by 4 at the 2-bit shift circuit 15 to enable reading-out of a sequence of four waveform samples at one time, and then the multiplied integer is supplied to the selector 14. In the present case, the signal COMP supplied to the selector 14 assumes "H" level since the data block contains compressed samples, and accordingly the selector 16 outputs the fourfold value of the integer INT.

The output from the selector 14 is added to the waveform start address WS supplied from the tone color generator at the adder 16, and the resulting sum is supplied to the adder 17, where an output value from 0 to 3 from the auxiliary counter 18 is sequentially added to the sum value. Consequently, the adder 17 sequentially outputs addresses of the four successive waveform samples to the waveform memory 19, from which the waveform samples R1 to R4 are sequentially output as shown as "READ-OUT DATA" in FIG. 10A.

The waveform samples R1 to R4 thus output are separated by the data separator 20 into one linear sample DO and eight compressed samples D1 to D8. More specifically, in FIG. 6 the waveform sample R1 is latched by the latch circuit 51, and is continuously output as shown as "LATCH OUTPUT" in FIG. 10A in response to the timing signal S1 shown as. "SIGNAL S2" in FIG. 10A.

On the other hand, the waveform samples R2 to R4 are separated by the selector 52 into the compressed samples D1 to D8, which are sequentially supplied to the timing adjusting circuit 54 in response to the timing signal Sn shown as "SIGNAL Sn" in FIG. 10A, and as shown in "OUTPUT D1 to D8" in the figure, the compressed samples D1 to D8 each having 6 bits are output at equal time intervals.

The waveform samples D0 to D8 from the data separator 20 are supplied as the output signal Wb to the decoder 21, which reproduces waveform samples before compression from the input waveform samples D0 to D8.

As shown in FIG. 7, the waveform sample D0 is input to the one input terminal of the selector $81$. When the select signal SD shown in FIG. 10A goes high ("H"), the selector $81$ outputs the waveform sample D0.

On the other hand, the waveform sample D1 is expanded to 16-bit data by the data expander $82$, and applied to the adder $83$, where it is added to the waveform sample D0 from the selector $81$, which has been delayed by the delay circuit 84. The resulting sum (calculated linear sample D1') is supplied via the limiter $85$ which prevents overflow of the sum to the other input terminal of the selector $81$. The calculated linear sample D1' is output from the selector $81$ when the select signal SD goes low ("L"), as shown in FIG. 10A.

Thereafter, in the same manner as described above, the waveform samples D2 to D8 are added to respective immediately preceding ones to form calculated linear samples D2' to D8', which are sequentially output from the selector $81$.

The calculated linear samples D0 to D8' thus reproduced are supplied as the output signal Wc to the 4-data output circuit 23. As shown in FIG. 8, the output signal Wc is input to the one input terminal of the selector 71. Since at this time the signal COMP input to the select terminal of the selector 71 is at "H" level, the output signal Wc is allowed to directly pass through the selector 71 and supplied to the delay circuit 74 with the pulse take-in function. At this time, as the output signal from the selector 72, the selecting pulse signal SS from the selecting pulse generator 73 is selected according to the signal COMP. That is, out of the six selecting pulse train SP as shown in FIG. 10B, one selecting pulse train SP selected from pulses of the selecting signal SS is supplied to the pulse input terminal of the delay circuit 74. The delay circuit 74 selects four successive calculated linear samples from the calculated linear samples D0 to D8' (S1 to S4) from the selector 71, in response to the selective pulse train SP, and outputs the same to the delay circuit 75 with the pulse take-in function when the loading signal LD is applied to the delay circuit 74.

As shown in FIG. 10B, the four successive calculated linear samples S1 to S4 taken into the delay circuit 75 in synchronism with the loading signal LD are output as the signal Wd in synchronism with fall of a pulse of the signal NP.

The calculated successive linear samples S1 to S4 of the output signal Wd are supplied to the interpolation circuit 29. As shown in FIG. 9, the calculated linear sample S1 is multiplied at the multiplier $81$ by the coefficient $\alpha 1$ which has been selected and output by the coefficient generator 82 based on an output value "0" from the auxiliary counter 83 and the signal FRAC' which is supplied thereto from the delay circuit 31 as a delayed signal of a decimal fraction FRFRAC taken out of the sixfold value of the decimal fraction FRAC. The output $\alpha 1 \times S1$ from the multiplier 81 is added by the adder 84 to an output signal from the gate 87. At this time, as shown in FIG.10B, the signal IP, which is at "H" level, is inverted to "L" level by the inverter 86, and then applied to the gate 87. Accordingly, the output signal from the gate 87 is equal to 0. Therefore, the output from the multiplier 81 is applied as it is to the delay circuit 85. The delayed output signal from the delay circuit 85 is supplied to the gate 87 as well as to the latch circuit 88.

Similarly to the calculated linear sample S1, the calculated linear sample S2 is multiplied by the coefficient 42 selected based on an output value "1" from the auxiliary counter 83 and the signal FRAC', and then added to the output signal from the gate 87 by the adder 84. At this time, as shown in FIG. 10B, the signal IP is at "L" level, and accordingly the gate 87 outputs the delayed signal $\alpha 1 \times S1$, and hence the output from the adder 84 is $\alpha 1 \times S1 + \alpha 2 \times S2$, which is delayed by the delay circuit 85 and latched by the latch circuit 88.

Similarly, the calculated linear samples S3, S4 are multiplied by the respective coefficients $\alpha 3$, $\alpha 4$ at the multiplier 81, and then added to the respective immediately preceding sums of signals from the adder 84, finally forming a signal of $\alpha 1 \times S1 + \alpha 2 \times S2 + \alpha 3 \times S3$-

$+\alpha 4\times S4$, which is delayed by the delay circuit 85 and latched by the latch circuit 88. Then, as shown in FIG. 10B, in synchronism with a rise of the next pulse of the signal IP, the interpolated sample We ($\alpha 1\times S1+\alpha 2\times S2+\alpha 3\times S3+\alpha 4\times S4$) is output from the latch circuit 88.

The interpolation sample We is multiplied at the multiplier 34 in FIG. 5B by the waveform of the envelope of the musical tone from the envelope generator 33. Signals of all the time-division channels thus obtained are accumulated by the channel accumulator 35. The accumulated data is output via the sound system 7 in FIG. 1 as the musical tone.

Then, description will be made of the second case in which a block containing only linear samples is selected from the data of waveform samples stored in the waveform memory 19 based on the performance data PD and the tone color number TN.

When the performance data PD and the tone color number TN are determined, as described above, the performance data PD is assigned by the assigning circuit 10 to one of the time slots provided by time division, and the tone color data generator 13 outputs various control signals mentioned before. The F number generator 11 outputs an F number value, the main counter 12 performs cumulative counting of the F number to obtain a real number, and the integer INT and decimal fraction FRAC of the real number are separately output.

The integer INT is supplied to the selector 14 as it is, since then the signal COMP applied to the select terminal of the selector 14 is at "L" level. The output signal INT is added by the adder 16 to the start address WS, and the resulting sum is sequentially added by the adder 17 to a sequence of output values 0 to 3 from the auxiliary counter 18 to determine addresses of data in the waveform memory 19 for access. According to the addresses thus determined, four linear samples, i.e. non-compressed waveform samples are sequentially read from the waveform memory 19, delayed by the delay circuit 22, and then supplied to the 4-data output circuit 23.

As shown in FIG. 8, at this time the signal COMP supplied to the select terminals of the selectors 71 and 72 is at "L" level, and accordingly the selector 71 delivers the linear sample delayed by the delay circuit 22 to the delay circuit 74. Then, upon fall of pulses of the signal NP in FIG. 10B to the pulse input terminal of the delay circuit 74 after the loading pulse signal LD is applied to the delay circuit 75, the linear samples R1 to R4 are sequentially delivered from the delay circuit 74 to the delay circuit 75.

The linear samples R1 to R4 are delivered from the delay circuit 75 as the signal Wd upon fall of the signal NP, as described above.

The signal Wd is supplied to the interpolation circuit 29. At this time the signal COMP applied to the selector 30 is at "L" level, so that the decimal fraction FRAC is delivered from the selector 30 as it is, and delayed by the delay circuit 31 into the signal FRAC', which is applied to the interpolation circuit 29.

The data processing carried out by the interpolation circuit 29 and the following component parts of the electronic keyboard instrument is similar to the first case described above, and hence description thereof is omitted.

Thus, according to the present embodiment, waveform samples are read from the waveform memory in blocks each containing at least one linear sample. Therefore, even if the waveform samples are read out by pitch-up, i.e. by skip access, it is possible to reproduce or reform compressed samples into linear samples. Further, the use of blocks containing compressed samples enables making efficient use of the waveform memory. This makes it possible to reduce the capacity of the memory and hence the manufacturing cost.

Although, in the embodiment described above, the four-point interpolation is employed and therefore each block containing compressed samples has six waveform samples. However, the use of interpolation is not essential. If the interpolation is omitted, adjacent blocks do not have to contain common or overlapped compressed samples, and then it should be designed that each block contains nine waveform samples which have respective addresses.

Further, the present invention may be applied to a tone generator incorporating a compression type waveform memory which is adapted to have certain stored waveform samples thereof repeatedly read out in a looped manner. This applied system dispenses with special processing in returning to the start of the loop.

Further, although in the embodiment each block containing compressed samples is formed of one linear sample and eight compressed samples, this is not limitative, but the number of compressed samples contained in one block may be changed as required.

Next, a second embodiment of the invention will be described.

This embodiment is distinguished from the first embodiment described above only in the data format of waveform samples stored in the waveform memory. Therefore, component elements and parts corresponding to those in the first embodiment are designated by identical reference numerals, and detailed description thereof is omitted. Also, this embodiment is applied to an electronic keyboard instrument having the same construction as employed in the first embodiment.

Figure 11:
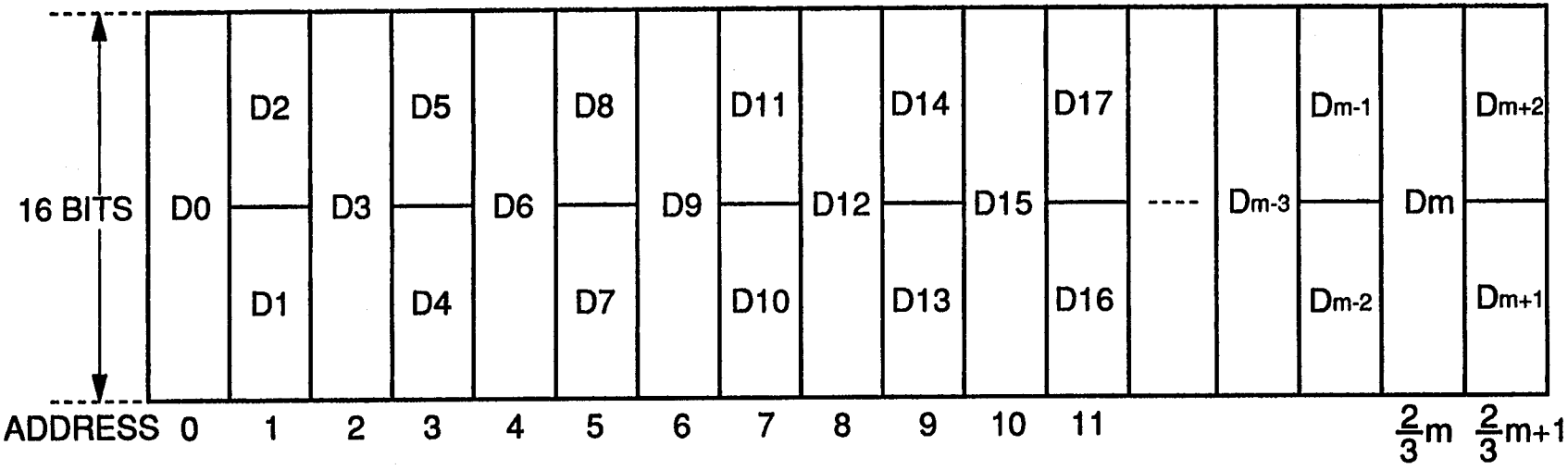
FIG. 11 is a diagram showing a format of waveform samples stored in the waveform memory, according to a second embodiment of the invention.

FIG. 11 shows a data format of waveform samples stored in the waveform memory 19 provided within the tone generator 5. The waveform memory 19 has a plurality of memory banks, each bank storing waveform samples of a musical tone. FIG. 11 shows waveform samples of a certain musical tone stored in the waveform memory 19.

Similarly to the first embodiment, each waveform data contains amplitude values (waveform amplitude values) of waveform samples sampled at successive sampling points. In the present embodiment, each bank contains linear samples each indicative of an amplitude value, and compressed samples each indicative of a difference in amplitude between one present waveform sample sampled at one sampling point and the immediately preceding waveform sample sampled at the immediately preceding sampling point. More specifically, each bank has a repetition of blocks each containing one 16-bit linear sample and two 8-bit compressed samples arranged in this order.

In FIG. 11, reference numeral D0 designates a 16-bit linear sample stored at an address 0 where reading of data should be started (i.e. offset address following the top of the bank), D1 an 8-bit compressed sample stored in the former half of the following address 1, and D2 an 8-bit compressed sample stored in the latter half of the same address. Similarly, D3, D6, D9, D9, . . . and Dm designate 16-bit linear samples stored at respective addresses 2, 4, 6, . . . and ($\frac{2}{3}$)m, D4, D7, D10, . . . , and Dm+1 8-bit compressed samples stored at the former halves of respective addresses 3, 5, 7, . . . , (2/3)m+1, and D5, D8, D11, . . . , and Dm+2 8-bit compressed samples stored at the latter halves of the same addresses.

One linear sample and the following two compresses samples form one block, as mentioned above. For example, data D0, D1, and D2 form one block, and data D3, D4 and D5 form another block.

Figure 12:
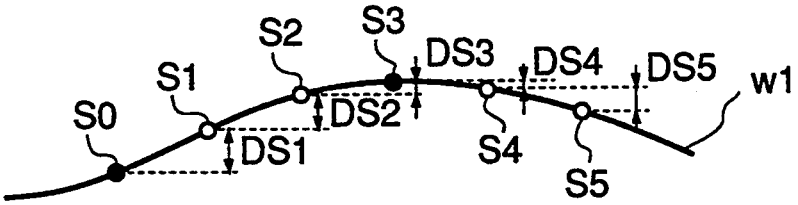
FIG. 12 is a diagram showing the relationship between waveform samples shown in FIG. 11 and the original waveform of the musical tone.

FIG. 12 shows the relationship between waveform samples shown in FIG. 11 stored in the waveform memory 19 and the original waveform of a musical tone from which the waveform samples are prepared. In FIG. 12, similarly to FIG. 4, reference numerals S0 to S4 designate sampling points at which the waveform is sampled. Linear samples are obtained at sampling points S0 and S3 shown in black dots, whereas compressed samples are obtained at sampling points S1, S2, S4, and S5 shown in circles.

In the present embodiment as well, the four-point interpolation method is employed for forming an output waveform of a musical tone. Accordingly, interpolation is carried out on waveform samples at respective four successive sampling points. The arrangement of waveform samples shown in FIG. 11 provides three possible combinations of waveform samples as follows, in order to form four successive waveform samples for interpolation:

[1-(1)] A linear sample, a compressed sample, a compressed sample, and a linear sample are selected in this order. For example, four samples D0, D1, D2, and D3 shown in FIG. 11 are sequentially obtained. A linear amplitude value of a waveform at the sampling point S1 corresponding to the compressed sample D1 is calculated by the use of the linear sample D0 according to the equation of D0+D1=D1'. A linear amplitude value of the waveform at the sampling point S2 corresponding to the compressed sample D2 is calculated by the use of the calculated linear sample D1' according to the equation of D1'+D2=D2'. Interpolation is carried out based on the data D0, D1', D2', and D3' thus obtained, to thereby obtain an amplitude value at an intended sampling point lying between the sampling point S0 corresponding to the data D0 and the sampling point S1 corresponding to the data D1'.

[1-(2)] A compressed sample, a compressed sample, a linear sample, and a compressed sample are selected in this order. For example, four samples D1, D2, D3, and D4 in FIG. 11 are sequentially obtained in this order. To obtain calculated linear samples D1' and D2' corresponding to the compressed samples D1 and D2, the use of the linear sample D0 is required. A calculated linear sample D4' is calculated by the use of the linear sample D3. Interpolation is carried out based on the data D1', D2', D3, and D4' thus obtained, to thereby obtain an amplitude value at an intended sampling point lying between the sampling point S1 corresponding to the data D1' and the sampling point S2 corresponding to the data D2'.

[1-(3)] A compressed sample, a linear sample, a compressed sample, and a compressed sample are selected in this order. For example, four samples D2, D3, D4, and D5 in FIG. 11 are sequentially obtained in this order. The use of the linear sample D0 and the compressed sample D1 is required to obtain calculated linear samples D2' corresponding to the compressed sample D2. Calculated linear samples D4' and D5' are calculated by the use of the linear sample D3. Interpolation is carried out based on the data D2', D3, D4', and D5' thus obtained, to thereby obtain an amplitude value at an intended sampling point lying between the sampling point S2 corresponding to the data D2' and the sampling point S3 corresponding to the data D3'.

As can be understood from the above, addressing of the waveform memory is carried out four times (in the above example, four waveform samples each having 16 bits are read from the addresses 0, 1, 2, and 3 in FIG. 11), starting with a linear sample, to thereby enable obtaining the four successive amplitude values at the respective sampling points for use in interpolation. In other words, reading of data from the waveform memory can be started with any address to obtain the four successive amplitude values for interpolation, insofar as two successive blocks of data are read out.

Next, description will be made of the construction of the tone generator 5 incorporating the waveform memory 19 constructed as above, with reference to FIG. 13.

Figure 13:
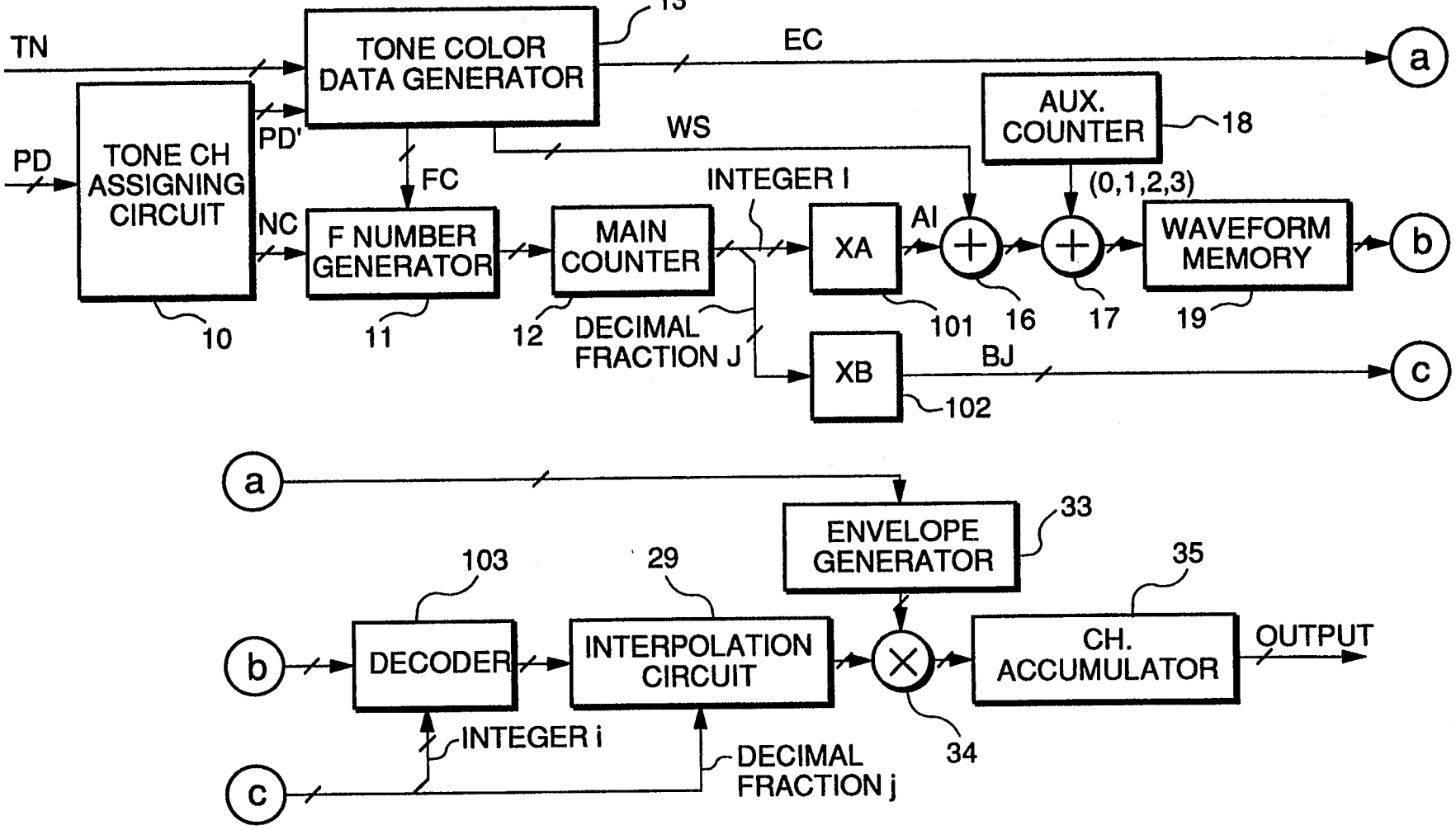
FIG. 13 is a diagram showing the construction of a tone generator appearing in FIG. 1 according to the second embodiment.

The construction of the tone generator 5 in FIG. 13 is substantially identical with that of the tone generator shown in FIG. 5A and FIG. 5B, except that it is adapted to reproduce a waveform of a musical tone by the use of waveform samples formatted as shown in FIG. 11, and it is simplified in construction as compared with that in FIG. 5A and FIG. 5B. Component elements and parts corresponding to those in FIG. 5A and FIG. 5B are designated by identical reference numerals, and detailed description thereof is omitted.

In FIG. 13, a multiplier 101 has a constant A which is selected such that a linear sample stored in the waveform memory 19 is addressed according to the sum (WS+I×A) of the waveform start address WS and a product (I×A) of an integer I of a count value from the main counter 12 and the constant A. As can be understood from FIG. 11, in the present embodiment linear samples are stored at addresses 0, 2, 4 . . . and therefore the above constant A is "2". This causes the above-mentioned sum obtained by the adder 16 to always designate an address for reading out a linear sample.

Further, in FIG. 13, a multiplier 102 has a constant B which is set at "3" in the present embodiment. As will be learned from FIG. 11 and FIG. 12, there are three sections from one linear sample to another, and the constant B is selected such that it can designate one of the sections which contains an intended sampling point at which a linear amplitude value of the waveform should be calculated by interpolation. An integer i ("0", "1", "2" or "3") of a product BJ of a decimal fraction J of the count value from the main counter 12 and the constant B is supplied to the decoder 103, which in turn sequentially outputs amplitude value data at successive sampling points, based on values of the integer i.

Next, how to determine the integer i and how the decoder 103 selects the four waveform samples based on the integer i will be described.

For example, let it be assumed that the four waveform samples at the addresses 4, 5, 6, and 7 shown in FIG. 11 are read from the waveform memory 19. This means that linear samples D6, D9 and compressed samples D7, D8, D9, D10, and D11 are supplied to the decoder 103.

Let it be assumed that the sampling point S0 corresponds to D6, the sampling point S1 to D7, the sampling point S2 to D8, the sampling point S3 to D9, the sampling point S4 to D10, and the sampling S5 to D11. Then, four successive amplitude values will be obtained in the following manners depending upon intended sampling points at which linear data should be obtained by interpolation.

[2-(1)] When the intended sampling point lies between the sampling points S0 and S1

The decimal fraction output from the main counter 12 is $0 \leqq J < (\frac{1}{3})$, and hence the product BJ of the decimal fraction J and the constant B (=3) is $0 \leqq BJ < 1$. The integer i of the product BJ is "0". The decoder 103 calculates, in response to the integer i=0 input thereto, the amplitude values (all of them are linear) at the sampling points S0, S1, S2 and S3 based on the waveform samples D6 to D11, and sequentially output these calculated values. That is, four amplitude values of the linear sample D6, a calculated linear sample D7' (=D6+D7), a calculated linear sample D8' (=D7'+D8) and the linear sample D9 are sequentially output.

[2-(2)] When the intended sampling point lies between the sampling points S1 and S2

The decimal fraction output from the main counter 12 in FIG. 13 is $(\frac{1}{3}) \leqq J < (\frac{2}{3})$, and hence the product BJ of the decimal fraction J and the constant B (=3) is $1 \leqq BJ < 2$. The integer i of the product BJ is "1". The decoder 103, calculates in response to the input integer i=1, the amplitude values (all of them are linear) at the sampling points S1, S2, S3, and S4 based on the waveform samples D6 to D11, and sequentially output these calculated values. That is, four amplitude values of a calculated linear sample D7' (=D6+D7), a calculated linear sample D8' (=D7'+D8), the linear sample D9 and the calculated linear sample D10' (=D9+D10) are sequentially output.

[2-(3)] When the intended sampling point lies between the sampling points S2 and S3

The decimal fraction output from the main counter 12 is $(\frac{2}{3}) \leqq J < 1$, and hence the product BJ of the decimal fraction J and the constant B (=3) is $2 \leqq BJ < 3$. The integer i of the product BJ is "2". The decoder 103 calculates, in response to the input integer i=2, the amplitude values (all of them are linear) at the sampling points S2, S3, S4, and S5 based on the waveform samples D6 to D11, and sequentially output these calculated values. That is, four amplitude values of a calculated linear sample D8' (=D7'+D8), the linear sample D9, a calculated linear sample D10' (=D9+D10), and a calculated linear sample D11' (=D10'+D11) are sequentially output.

Figure 14:
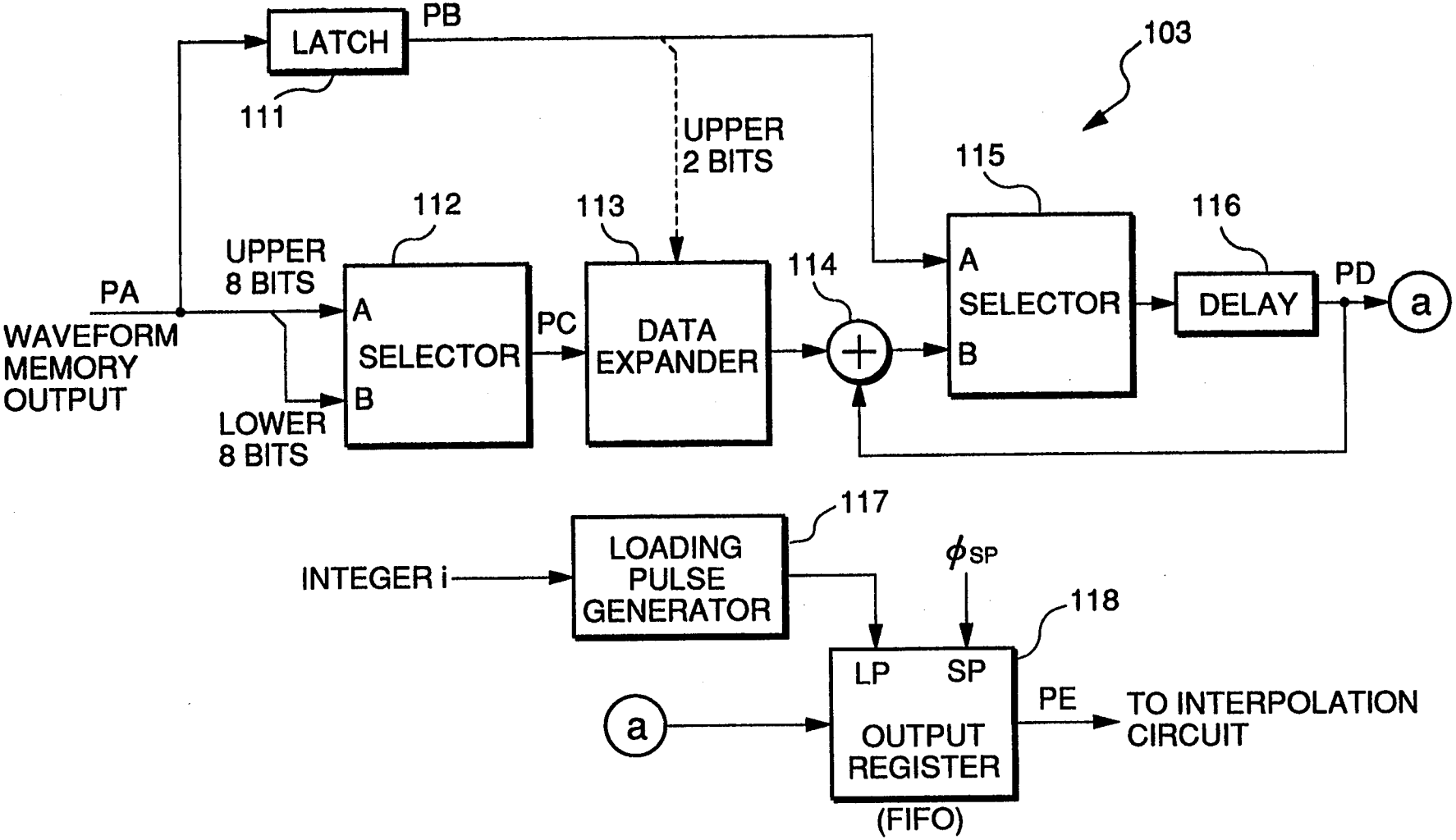
FIG. 14 is a diagram showing the construction of a decoder appearing in FIG. 13.

Next, details of the construction and operation of the decoder 103 will be described with reference to FIG. 13 and FIG. 14. As shown in FIG. 14, the decoder 103 is comprised of a latch circuit 111, a selector 112, a data expander 113, an adder 114, a selector 115, a delay circuit 116, a loading pulse generator 117, and a output resister 118.

The output from the waveform memory 19 is supplied to the latch circuit 111 and the selector 112. The latch circuit 111 latches especially linear samples among data input thereto. An output (16-bit waveform sample) from the latch 111 is applied to an input terminal A of the selector 115.

The selector 112 separates a waveform sample consisting of two compressed samples (8 bits×2=16 bits) into two separate compressed samples. The selector 112 has an input terminal A thereof supplied with the upper 8-bit data of the 16-bit waveform sample from the waveform memory 19 and an input terminal B thereof with the lower 8-bit data of the same waveform sample.

The data expander 113 expands the compressed sample (8-bit waveform sample) from the selector 112 to a 16-bit waveform sample (by adding 8 bits of "0" as upper bits). The output from the data expander 113 is supplied to the adder 114. The adder 114 is also supplied with output data from the delay circuit 116. The adder 114 adds up these input data and delivers the resulting sum (16-bit waveform sample) to an input terminal B of the selector 115.

Thus, the adder 114 carries out addition of a compressed sample and a linear or calculated linear sample, to form a calculated linear sample corresponding to the compressed sample.

More specifically, when a linear sample is supplied from the waveform memory 19, the linear sample is latched by the latch circuit 111 and delivered via the selector 115 to the delay circuit 116, where it is held. Following the linear sample, a waveform sample consisting of two compressed samples is supplied to the decoder 103.

The first compressed sample is separated from the second one by the selector 112 and then expanded to a 16-bit waveform sample by the data expander 113 to be delivered therefrom to the adder 114. At this time, the delay circuit 116 outputs the immediately preceding linear (or calculated linear sample) to the adder 114. These two waveform samples supplied to the adder 114 are added together to form a calculated linear sample at a sampling point corresponding to the compressed sample. This calculated linear sample is delivered via the selector 115 and the delay circuit 116 to the output register 118. The following compressed sample is processed similarly into a calculated linear sample corresponding thereto.

As a result, the delay circuit 116 outputs a sequence of six linear amplitude value data at successive six sampling points which are contained in waveform samples stored in four address locations in the waveform memory 19.

The linear amplitude waveform samples from the delay circuit 116 are loaded into the output register 118. Loading is carried out based on loading pulses generated from the loading pulse generator 117.

The loading pulse generator 117 outputs loading pulses based on the integer i supplied from the amplifier 102 in FIG. 13, such that only four waveform samples to be loaded are selected from the six successive linear amplitude waveform samples from the delay circuit 116, and then loaded into the output register 118. The output register 118 is a FIFO (First-In First-Out) register, and the loaded amplitude data are read out in response to pulses $\phi$SP having a predetermined repetition period. The amplitude waveform samples read from the output register 118 are supplied to an interpolation circuit 29.

Next, the operation of the decoder 103 will be described in further detail, with reference to a specific example.

Figure 15:
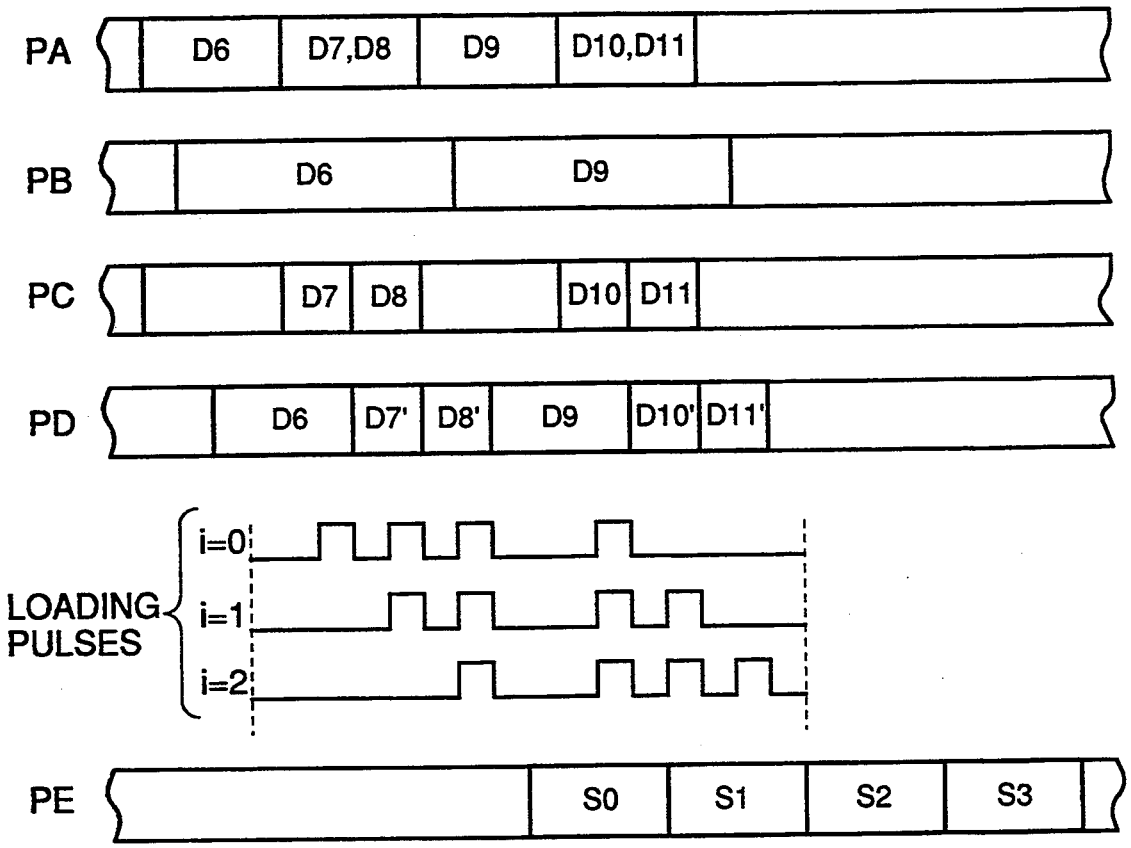
FIG. 15 is a timing chart which is useful in explaining operation of the decoder.

FIG. 15 shows a timing chart which is useful in explaining the operation of the decoder 103. In the figure, symbols PA to PE represent timing of signals at points designated by the same symbols PA to PE in FIG. 14, respectively. The present example is based upon the assumption that waveform samples stored at the addresses 4, 5, 6, and 7 in FIG. 11 (i.e. waveform samples D6 to D11) are sequentially input to the decoder 103.

As shown at PA of FIG. 14, the linear sample D6 at the address 4, the compressed samples D7 and D8 at the address 5, the linear sample D9 at the address 6, and the compressed samples D10 and D11 at the address 7 are sequentially supplied from the waveform memory 19 to the decoder 103. PB represents the timing of an output from the latch 111. The latch 111 latches the linear sample D6 and the linear sample D9 and delivers them to the selector 115.

PC represents the timing of an output from of the selector 112. The selector 112 selectively outputs the compressed sample D7 during the first half of a time slot during which the compressed samples D7 and D8 are output from the waveform memory 19, and the compressed sample D8 during the second half of the time slot.

PD represents the timing of an output from the delay circuit 116. The delay circuit 116 holds the linear sample D6 which is supplied thereto via the latch 111 and the selector 115, and delivers the same to the adder 114.

While the linear sample D6 is delivered from the adder 114, the compressed sample D7 is delivered via the data expander 113 to the adder 114, as shown at PC in FIG. 15, where the linear sample D6 and the compresses sample D7 in an expanded form are added together to form a calculated linear sample D7′=D6+D7, which is linear to the amplitude of the waveform at a sampling point corresponding to the compressed sample D7. The calculated linear sample D7′ is transferred via the selector 115 to the delay circuit 116, and then delivered therefrom, following the linear sample D6, as shown at PD in FIG. 15.

While the linear sample D7′ is delivered from the adder 114, the following compressed sample D8 is supplied via the data expander 113 to the adder 114, where the linear sample D7′ and the compresses sample D8 in an expanded form are added together to form a calculated linear sample D8′=D7′+D8, which is linear to the amplitude of the waveform at a sampling point corresponding to the compressed sample D8. The calculated linear sample D8′ is transferred via the selector 115 to the delay circuit 116, and then delivered therefrom, following the linear sample D7′, as shown at PD in FIG. 15.

As a result, as shown at PD in FIG. 15, the linear sample D6 (which is originally linear to the amplitude value), the calculated linear value D7′=D6+D7 (which is linear to the amplitude value at the sampling point corresponding to the compressed sample D7), and the calculated linear value D8′=D7′+D8 (which is linear to the amplitude value at the sampling point corresponding to the compressed sample D8) are sequentially delivered to the output register 118. The following samples D9 to D11 are also processed similarly, so that the linear sample D9, the calculated linear sample D10′, and the calculated linear sample D11′ are sequentially delivered to the output register 118.

The six linear amplitude waveform samples sequentially delivered as shown at PD in FIG. 15 are loaded into the output register 118. Loading pulses from the loading pulse generator 117 are generated at timing shown at LOAD PULSE in FIG. 15 to cause loading of the six linear amplitude waveform samples.

First, when the integer i from the multiplier 102 in FIG. 13 is equal to "0", i.e. in the above described case of [2-(1)], loading pulses are generated such that the waveform samples D6, D7′, D8′ and D9 are loaded into the output register 118. When the integer i is equal to "1", i.e. in the case of [2-(2)], loading pulses are generated such that the waveform samples D7′, D8′, D9 and D10′ are loaded into the output register 118. When the integer i is equal to "2", i.e. in the case of [2-(3)], loading pulses are generated such that the waveform samples D8′, D9 , D10′ and D11′ are loaded into the output register 118.

PE in FIG. 15 represents the timing of a sequence of waveform samples output from the output register 118. As noted before, four amplitude waveform samples loaded into the output register 118 are read out sequentially as S0, S1, S2, S3 based on the pulse signal $\phi$SP with the predetermined repetition period.

In the above described manner, the decoder 103 sequentially outputs four linear waveform samples of amplitude values at respective sampling points based on the value ("0", "1", or "2′) of the integer i. In addition, a timing signal generator, not shown, is provided for supplying the component elements of the decoder 103 with timing signals for control of the operation thereof described above, similarly to the first embodiment.

Referring again to the FIG. 13, the decimal fraction j of the product BJ is supplied to the interpolation circuit 29. The interpolation circuit 29 carries out interpolation based on the four amplitude value data supplied from the decoder 103, to output an interpolated waveform sample. The same interpolating method as that employed in the first embodiment is employed by the interpolation circuit 29, and therefore detailed description thereof is omitted.

Further, the waveform data formed by interpolation is processed similarly to that employed in the first embodiment, and therefore description thereof is also omitted.

As described above, according to the second embodiment, it is possible to obtain data on the waveform of a musical tone from any of the address locations of linear samples within the waveform memory, enabling reading out data by skip access, i.e. by skipping over waveform samples. Further, compression of data can be effectively utilized to avoid an increased memory capacity.

Although in the above described embodiments, each linear sample is formed by a 16-bit waveform sample, and each compressed sample by a 8-bit waveform sample, this not limitative, but linear samples with a reduced number of bits may be employed, so as to enable using the remaining bits for increasing the value range of a compressed sample that can be represented by the compressed sample.

Figure 16:
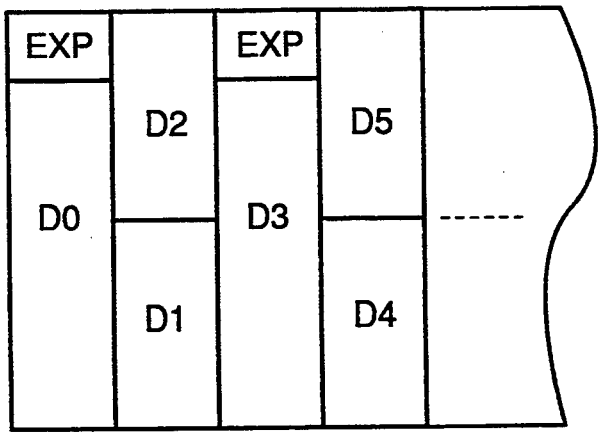
FIG. 16 is a fragmentary diagram showing a waveform data format of waveform samples of a musical tone stored in the waveform memory, according to a variation of the second embodiment.

FIG. 16 shows a variation of the second embodiment. According to the variation, the linear sample is formed by a 14-bit waveform sample, and the remaining 2 bits (upper bits) are used for shifting up the compressed samples. The 2-bits are designated by EXP.

When EXP=0, the following two 8-bit compressed samples are not shifted up, so that the compressed samples have a value range of −128 to +127. When EXP=1, the following two 8-bit compressed samples are shifted up by one bit, so that the compressed samples have a value range of −256 to +255. However, the resolution is 2. When EXP=2, the following two 8-bit compressed samples are shifted up by 2 bits, so that the compressed samples have a value range of −512 to +511. However, the resolution is 4. When EXP=3, the following two 8-bit compressed samples are shifted up by 3 bits, so that the compressed samples have a value range of −1024 to +1023. However, the resolution is 8.

The shifting-up of compressed samples is carried out to expand the range of a difference in amplitude between sampling points which can be represented by a compressed sample, to thereby enable compressed samples to represent a waveform of a musical tone which is drastically or largely changing in amplitude.

In order to effect the shifting-up of compressed samples, the second embodiment of FIG. 14 described above may be altered such that the output from the latch 111 has two upper bits for EXP. The two upper bits are supplied to the data expander 113, while the 14-bit waveform sample is supplied to the selector 115, with its two upper bits for EXP both set to "0". Then, the data expander 113 shifts up compressed samples as described above, depending on the value of EXP.

Although, in the above described embodiments, one linear sample is prepared every three sampling points, and interpolation is carried out by the use of four data from successive four sampling points, this is not limitative, but this interpolation method may be modified as desired. For example, one linear sample may be prepared every five sampling points, and interpolation may be carried out by the use of data from successive two sampling points.

Next, a third embodiment of the invention which employs this method will be described.

Figure 17:
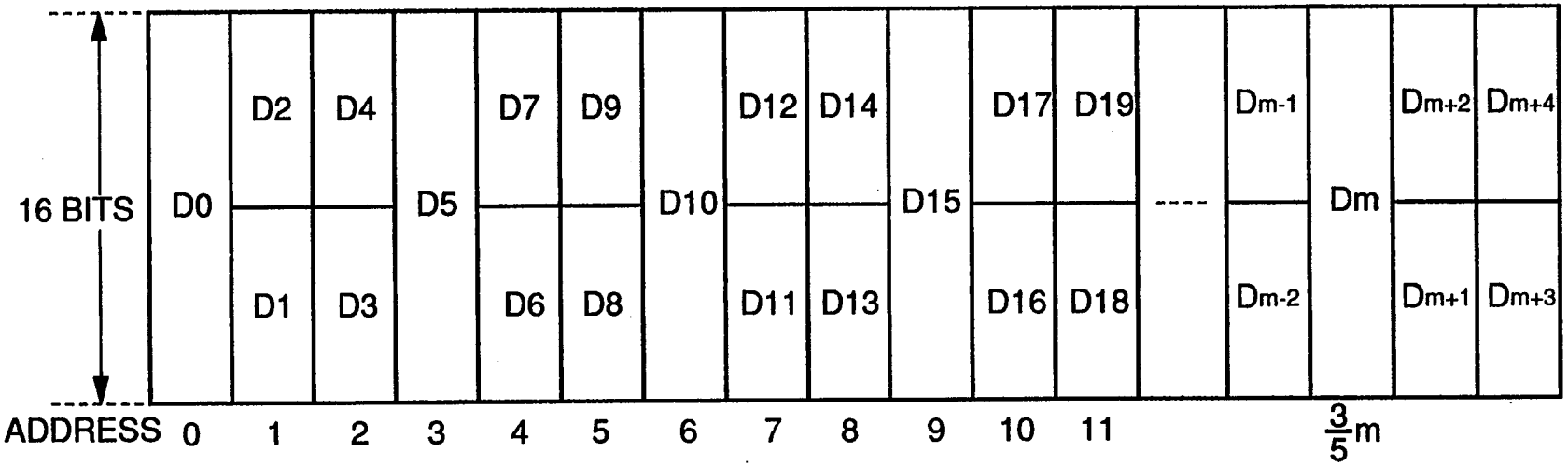
FIG. 17 is a diagram showing a waveform data format of waveform samples of a musical tone stored in the waveform memory, according to a third embodiment of the invention.

FIG. 17 shows a format of waveform data which includes one linear sample taken from every five sampling points. D0 designates a 16-bit linear sample, D1, D2, D3, and D4 each designate a 8-bit compressed sample. Similarly, D5 in the following portion of the data is a 16-bit linear sample, and D6, D7, D8 and D9 are each a 8-bit compressed sample.

Figure 18:
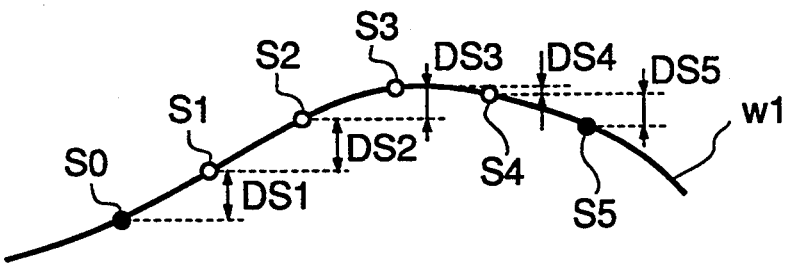
FIG. 18 is a diagram showing the relationship between waveform samples shown in FIG. 17 and the original waveform of the musical tone.

FIG. 18 shows the relationship between waveform data and original the waveform of a musical tone from which the data are prepared. Similarly to FIG. 4, points S0 to S5 represent sampling points, of which linear samples are taken at S0 and S5, indicated in black dots, while compressed samples are taken at S1 to S4, indicated in circle.

According to the third embodiment, interpolation is carried out by the use of data from two successive sampling points. When the sampled waveform data are stored in the memory in an arrangement as shown in FIG. 17, the following five combinations of sample data can be used to obtain data from two successive sampling points:

[3-(1)] Combination of data such as D5 and D6 as shown in FIG. 17 from two points (sampling points S0 and S1 in FIG. 18);

[3-(2)] Combination of data such as D6 and D7 from two sampling points (S1, S2);

[3-(3)] Combination of data such as D7 and D8 from two sampling points (S2, S3);

[3-(4)] Combination of data such as D8 and D9 from two sampling points (S3, S4); and

[3-(5)] Combination of data such as D9 and D10 from two sampling points (S4, S5).

Therefore, when addressing of the waveform memory four times starting with a linear sample, it is possible to obtain amplitude values of a waveform at adjacent two sampling points.

Thus, the waveform-forming device according to the third embodiment which employs a data format including one linear sample every five waveform samples can be constructed similarly to that shown in FIG. 13 and FIG. 14, except that the multiplying constant A of the multiplier 101 is equal to "3", the multiplying constant B of the multiplier 102 is equal to "5", and the auxiliary counter 18 outputs a value of "0" or "1".

The constant A of the multiplier 101 is a multiplier for making the adder 16 output an address in the waveform memory 19 for reading out a linear sample. As shown in FIG. 17, linear samples are stored at the addresses 0, 3, 6 . . . and hence the value of the above constant A should be equal to "3".

The constant B of the multiplier 102 is a multiplier by which is multiplied the decimal fraction J from the main counter 12 to obtain the product BJ the integer i of which is used to determine from which combination of the possible cases [3-(1)] to [3-(5)] a desired sample is to be formed, and therefore the constant B should be set to "5" so as to cause the integer i to assume a value of 0 through 4.

The auxiliary counter 18 outputs a count value corresponding to the number of samples used for interpolation. Since in the present case, a two-point interpolation is carried out, the auxiliary counter 18 is required to output a value of "0" and "1" alternately. In the interpolation circuit 29 as well, the auxiliary counter 83 is required to output a value of "0" and "1" alternately.

Further, the decoder used in the third embodiment may have a similar construction to that in FIG. 4. Since in the third embodiment, however, every fifth sample is a linear sample, and the two-point interpolation is carried out, the timing of operation of the latch 11 and the timing of outputting load pulses from the load pulse generator 117 are different from those set in the second embodiment of FIG. 14. Description of them will be made below, with reference to FIG. 19 showing timing of signals related to the operation of the decoder 103 used in the third embodiment.

Figure 19:
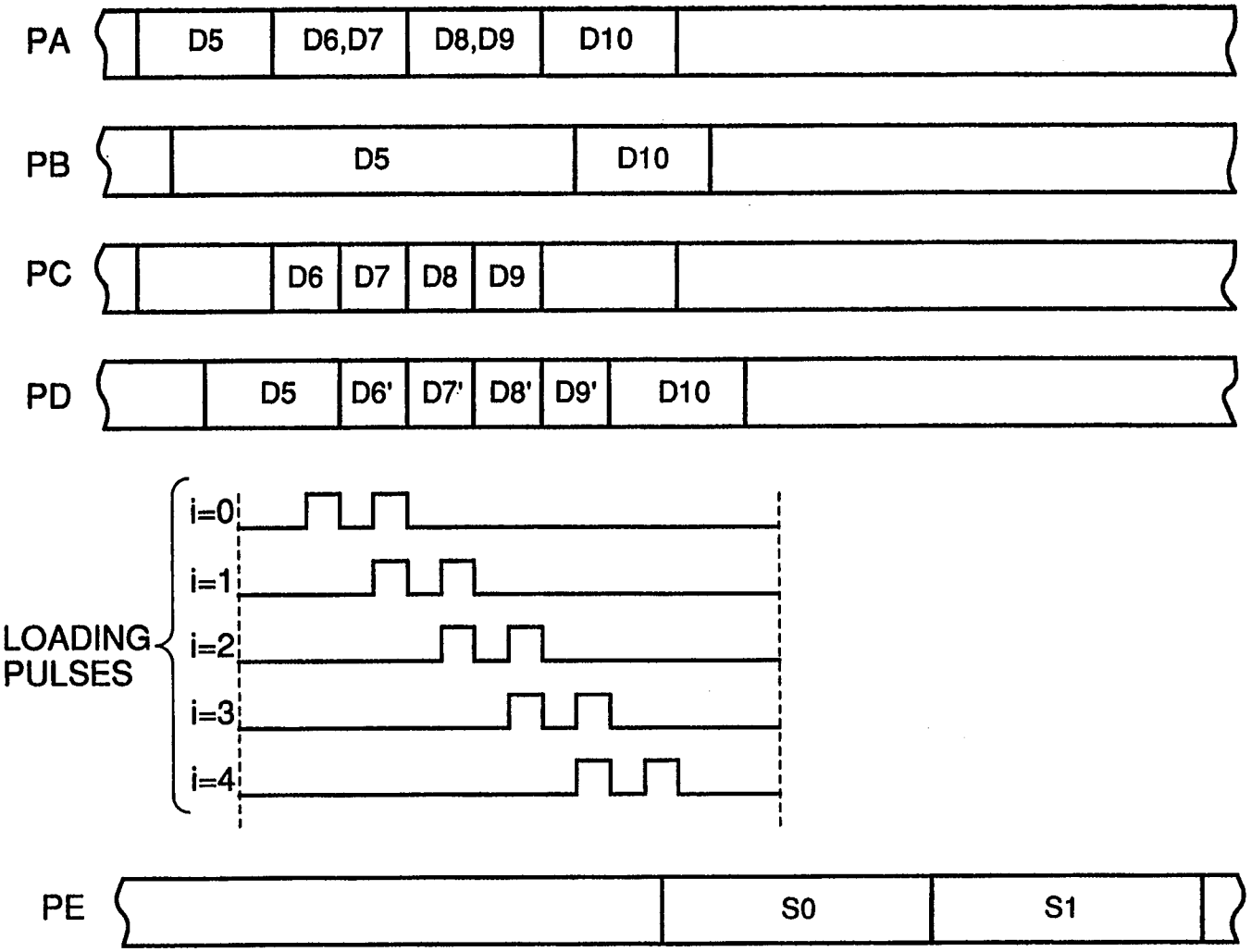
FIG. 19 is a timing chart which is useful in explaining the operation of the decoder, according to the third embodiment.

In FIG. 19, PA to PE represent timing of signals at points represented by the same symbols in FIG. 14, respectively. In the present example, description will be made of a case where waveform sample data stored at the addresses 3, 4, 5, and 6 appearing in FIG. 17 (i.e. waveform samples D5 to D10) are sequentially delivered to the decoder 103.

I Let it be assumed that as shown at PA in FIG. 19, the linear sample D7 at the address 3, the compressed samples D6 and D7 at the address 4, the compressed samples D8 and D9 at the address 5, and the linear sample D10 at the address 6 are sequentially delivered to the decoder 103. PB represents an output from the latch 111, which latches and delivers the linear sample D5 and the linear sample D10.

PC represents the timing of an output from the selector 112. The selector 112 selectively outputs the compressed sample D6 during the first half of a time slot during which the compressed samples D6 and D7 are read from the waveform memory 19, and the compressed sample D7 during the second half of the time slot. Similarly, the selector 112 selectively outputs the compressed sample D8 during the first half of a time slot during which the compressed samples D8 and D9 are read from the waveform memory 19, and the compressed sample D9 during the second half of the time slot.

PD represents the timing of an output from the delay circuit 116. The delay circuit 116 holds the linear sample D5 which is supplied thereto via the latch 111 and the selector 115, and delivers the same to the adder 114.

While the linear sample D5 is output from the adder 114, the compressed sample D6 is delivered via the data expander 113 to the adder 114, where the linear sample D5 and the compresses sample D6 in an expanded form are added together to form a calculated linear sample D6′=D5+D6, which is linear to the amplitude of the waveform at a sampling point corresponding to the compressed sample D6. The calculated linear sample D6′ is transferred via the selector 115 to the delay circuit 116, and then output therefrom, following the linear sample D5, as shown at PD in FIG. 19.

While the linear sample D6′ is output from the delay circuit 116, the following compressed sample D7 is delivered from the selector 115 via the data expander 113 to the adder 114, where the calculated linear sample D6′ and the compressed sample D7 in an expanded form are added together to form a calculated linear sample D7′=D6′+D7, which is linear to the amplitude of the waveform at a sampling point corresponding to the compressed sample D7. The calculated linear sample D7′ is transferred via the selector 115 to the delay circuit 116, and then output therefrom, following the calculated linear sample D6′, as shown at PD in FIG. 19.

Thereafter, similarly, the calculated linear samples D8′, D9′ are output, followed by the linear sample D10, as well. As a result, as shown at PD in FIG. 19, the linear sample D5, the calculated linear samples D6′, D7′, D8′, and D9′, and the linear sample D10 are sequentially delivered to the output register 118.

The six liner amplitude waveform samples sequentially output as shown at PD of FIG. 19, are loaded into the output register 118. Loading pulses determining the timing of loading selected successive ones of these data are generated at timing as shown at LOAD PULSE in FIG. 19.

First, when the integer i output from the multiplier 102 in FIG. 13 is equal to "0", i.e. in the above described case of [3-(1)], loading pulses are generated such that the data D5 and D6′ are loaded into the output register 118. When the integer i is equal to "1", i.e. in the above described case of [3-(2)], loading pulses are generated such that the data D6′ and D7′ are loaded into the output register 118. When the integer i is equal to "2", i.e. in the above described case of [3-(3)], loading pulses are generated such that the data D7′ and D8′ are loaded into the output register 118. When the integer i is equal to "3", i.e. in the above described case of [3-(4)], loading pulses are generated such that the data D8′ and D9′ are loaded into the output register 118. When the integer i is equal to "4", i.e. in the above described case of [3-(5)], loading pulses are generated such that the data D9′ and D10 are loaded into the output register 118.

PE in FIG. 19 represents a sequence of data output from the output register 118. As described above, four amplitude waveform samples loaded into the output register 118 are read out sequentially as S0 and S1, based on the pulses $\phi$SP having a predetermined repetition period.

In the above described manner, the decoder 103 sequentially outputs two successive linear samples of amplitude values at respective sampling points based on the value ("0", "1", "2", "3" or "4") of the integer i.

According to the third embodiment described above, a linear sample is provided every fifth waveform sample, and as a result, the data compression ratio is higher than in the second embodiment.

Also in the third embodiment, as mentioned in the second embodiment, the number of bits of a linear sample can be reduced to enable increasing the value range of a compressed sample that can be represented by the compressed sample, by the use of the resulting remaining bits. To this end, the construction of FIG. 16 can be directly applied.

Although in the first to third embodiments described above, the waveform-forming device according to the invention is applied to a tone generator of an electronic musical instrument, this is not limitative, but the present waveform-forming device may be applied to a telephone with a voice memory and tape recorders to read waveform samples from the memory by skip access for "pitch-up" etc.

Further, although in the above described embodiments, the DPCM method is employed to form compressed samples of a waveform of a musical tone, this is not limitative, but any data-compressing method maybe applied such as an LPC method and an ADPCM method, insofar as data can be reproduced based on a preceding reproduced data and a new data.

What is claimed is:

1. A waveform-forming device for forming waveforms of musical tones, comprising:

waveform memory means for storing a plurality of blocks of waveform samples representative of a waveform of a musical tone, each block being formed of at least one non-compressed waveform sample and a plurality of compressed waveform samples;

reading means for reading said waveform samples block by block, from said waveform memory means, based on a pitch of a musical tone to be formed;

converting means for converting said compressed waveform samples contained in each block, read by said reading means, into non-compressed waveform samples; and waveform-forming means for forming said waveform of said musical tone from said at least one non-compressed waveform sample of said each block and said non-compressed waveform samples obtained by said converting means.

2. A waveform-forming device according to claim 1, further comprising pitch-designating means for designating said pitch of said musical tone to be formed.

3. A waveform-forming device according to claim 1 or 2, wherein said reading means reads out said waveform samples at a frequency irrespective of a frequency of a waveform to be formed, the device further comprising:

interpolating means for performing interpolation on said non-compressed waveform samples contained in said each block and obtained by conversion of said converting means, to form said waveform of said musical tone, a number at least $m-1$ of waveform samples located at a tail portion of said each block being identical with a number at least $m-1$ of waveform samples located at a head portion of an immediately subsequent block thereof, when said interpolating means performs interpolation by the use of a number m of waveform samples.

4. A waveform-forming device for forming waveforms of musical tones, comprising:

waveform memory means for storing non-compressed waveform samples located at intervals of a predetermined number of sampling points, and compressed waveform samples each located between adjacent ones of said non-compressed waveform samples;

frequency information-generating means for generating information on a frequency corresponding to a pitch of a musical tone to be formed;

cumulating means for cumulating said frequency information at a predetermined speed to output a cumulative value;

reading means for reading, based on said cumulative value, a non-compressed waveform sample and a plurality of compressed waveform samples subsequent to said non-compressed waveform sample, from said waveform memory means; and converting means for converting said plurality of compressed waveform samples read by said reading means into non-compressed waveform samples using said non-compressed waveform sample.

5. A waveform-forming device according to claim 4, further comprising:

selecting means for selecting, based on said cumulative value, non-compressed waveform samples to be used for interpolation, out of said non-compressed waveform sample and said plurality of non-compressed waveform samples.

6. A waveform-forming device according to claim 4, further comprising:

interpolating means for performing interpolation, based on said cumulative value, on non-compressed waveform samples selected by said selecting means, to output a result of said interpolation as a waveform sample of a musical tone.

7. A waveform-forming device for forming waveforms of musical tones, comprising:

waveform memory means storing non-compressed waveform samples located at intervals of a predetermined number of sampling points, and compressed waveform samples each located between adjacent ones of said non-compressed waveform samples;

frequency information generating means for generating information on a frequency corresponding to a pitch of a musical tone to be formed;

cumulating means for cumulating said information at a predetermined speed to output a cumulative value;

reading means for reading, based on said cumulative value, a plurality of non-compressed waveform samples and compressed waveform samples sequentially arranged, from said waveform memory means;

converting means for converting said compressed waveform samples read by said reading means into non-compressed waveform samples in a manner such that said compressed samples are converted by the use of an immediately preceding one of said non-compressed waveform samples;

selecting means for selecting, based on said cumulative value, non-compressed waveform samples to be used for interpolation, out of said non-compressed waveform samples obtained by reading means and said non-compressed waveform samples obtained by said converting means; and interpolating means for performing interpolation, based on said cumulative value, on non-compressed waveform samples selected by said selecting means, to output results of said interpolation as a waveform of a musical tone.

8. A waveform-forming device for forming a waveform of a musical tone, comprising:

waveform memory means for storing non-compressed waveform samples located at intervals of a predetermined number of sampling points, and compressed waveform samples each located between adjacent ones of said non-compressed waveform samples;

converting means for converting said compressed samples into non-compressed waveform samples by the use of immediately preceding one of said non-compressed waveform samples; and tone forming means for forming a waveform of a musical tone in accordance with said non-compressed waveform samples converted by said converting means and said non-compressed waveform samples stored in said waveform memory means.

9. A method of forming waveforms of musical tones comprising the steps of:

a step for storing a plurality of blocks of waveform samples representative of a waveform of a musical tone, each block being formed of at least one non-compressed waveform sample and a plurality of compressed waveform samples;

a step for designating a pitch of a musical tone to be formed;

a step for reading said waveform samples block by block, based on the designated pitch;

a step for converting said compressed waveform samples contained in each block, read by said reading means, into non-compressed waveform samples; and a step for forming said waveform of said musical tone from said at least one non-compressed waveform sample of said each block and said non-compressed waveform samples obtained by said converting means.

10. A method of forming waveforms of musical tones comprising the steps of:

a step for storing non-compressed waveform samples located at intervals of a predetermined number of sampling points, and compressed waveform samples each located between adjacent ones of said non-compressed waveform samples;

a step for generating information on a frequency corresponding to a pitch of a musical tone to be formed;

a step for cumulating said frequency information at a predetermined speed to output a cumulative value;

a step for reading, based on said cumulative value, a non-compressed waveform sample and a plurality of compressed waveform samples subsequent to said non-compressed waveform sample; and a step for converting said plurality of compressed waveform samples read by said reading means into non-compressed waveform samples using said non-compressed waveform sample.

* * * * *